US007527190B1

(12) United States Patent
Bowers et al.

(10) Patent No.: US 7,527,190 B1
(45) Date of Patent: May 5, 2009

(54) WEATHER BARRIER MAILBOX

(75) Inventors: John M. Bowers, Orlando, FL (US); Yun Tim Li, Guangdong (CN); Zhongqin Zhen, Guangdong (CN); Craig W. Walker, Rio Rancho, NM (US)

(73) Assignee: Euroasia Products Inc., Orlando, FL (US)

( * ) Notice: Subject to any disclaimer, the term of this patent is extended or adjusted under 35 U.S.C. 154(b) by 0 days.

(21) Appl. No.: 11/786,271

(22) Filed: Apr. 11, 2007

(51) Int. Cl.
*B65G 11/04* (2006.01)

(52) U.S. Cl. ..... 232/45; 232/17; 232/38

(58) Field of Classification Search ..... 232/45, 232/17, 38, 44, 43.1, 43.4; 220/834, 849, 220/810, 833, 835; 49/483.1
See application file for complete search history.

(56) References Cited

U.S. PATENT DOCUMENTS

| | | | | |
|---|---|---|---|---|
| 1,037,348 | A | 9/1912 | Smith | |
| 1,136,505 | A | 4/1915 | Razny | |
| 1,690,967 | A | 11/1928 | Cobb | |
| 1,824,881 | A | 9/1931 | Foss | |
| 2,169,855 | A | 8/1939 | Stough | 232/41.4 |
| 2,437,053 | A | 3/1948 | Swanson | 232/25 |
| 2,484,718 | A | 10/1949 | McCullar | 232/34 |
| 2,960,265 | A | 11/1960 | Simon | 232/25 |
| 3,208,668 | A | 9/1965 | Dickins Sr. | 232/33 |
| 3,659,778 | A * | 5/1972 | Saultz et al. | 232/43.1 |
| 3,722,460 | A | 3/1973 | James, Sr. | 116/132 |
| 3,733,026 | A | 5/1973 | Rowe et al. | 232/35 |
| 3,758,027 | A | 9/1973 | Morgan | 232/17 |
| 3,827,626 | A | 8/1974 | Daigle | 232/17 |
| 3,874,583 | A | 4/1975 | Moll | 232/17 |
| 4,186,869 | A | 2/1980 | Brown | 232/17 |
| 4,187,978 | A | 2/1980 | Dowker | 232/39 |
| 4,236,665 | A | 12/1980 | Glass | 232/39 |
| 4,403,730 | A | 9/1983 | Batson | 232/39 |
| 4,413,770 | A * | 11/1983 | Nye | 232/17 |
| 4,901,913 | A | 2/1990 | Fischer | 232/17 |
| 4,905,892 | A | 3/1990 | Fischer | 232/17 |
| 5,121,834 | A * | 6/1992 | Tissembaum | 206/38.1 |
| 5,337,954 | A | 8/1994 | Kobilarcik et al. | 232/38 |
| 5,339,980 | A | 8/1994 | Stutler | 220/571 |
| 5,362,019 | A | 11/1994 | Swanson | 248/146 |
| 5,617,993 | A * | 4/1997 | Morris | 232/27 |
| 5,645,215 | A * | 7/1997 | Marendt et al. | 232/17 |
| 5,713,514 | A | 2/1998 | Eck | 232/39 |
| 5,921,117 | A | 7/1999 | Illguth | 70/159 |
| 6,109,519 | A * | 8/2000 | McClure | 232/17 |
| 6,234,388 | B1 | 5/2001 | Taylor | 232/47 |
| 6,244,505 | B1 | 6/2001 | Grimes et al. | 232/47 |
| 6,719,195 | B2 * | 4/2004 | Farentinos | 232/45 |
| 6,722,561 | B1 * | 4/2004 | Thomas et al. | 232/39 |
| 6,772,939 | B1 | 8/2004 | Simpson | 232/38 |

(Continued)

*Primary Examiner*—William L. Miller
(74) *Attorney, Agent, or Firm*—Brian S. Steinberger; Law Offices of Brian S. Steinberger, P.A.

(57) ABSTRACT

Moisture resistant barrier mailbox apparatus, device and methods for inhibiting water intrusion into mailboxes where the doors can be positioned into open ends of the mailbox and/or when the doors have outer edges which wrap about open ends of the mailbox. Channel grooves and inwardly bent edges block and control water intrusion when the doors are in closed positions. The mailboxes can include drainage holes in the mailbox floors to allow for water to drain out of and not puddle inside of the mailboxes.

5 Claims, 24 Drawing Sheets

U.S. PATENT DOCUMENTS

| | | | | |
|---|---|---|---|---|
| 7,025,250 | B2 * | 4/2006 | Wolfe, Jr. | 232/35 |
| 7,090,119 | B1 * | 8/2006 | Lackey et al. | 232/45 |
| 7,172,163 | B1 | 2/2007 | Johnson | 248/146 |
| 7,178,772 | B2 | 2/2007 | Riker | 248/219.2 |
| 7,252,220 | B1 * | 8/2007 | Shreve | 232/45 |
| 2002/0059691 | A1 | 5/2002 | Audisio | 16/374 |
| 2004/0124200 | A1 * | 7/2004 | Yuhara | 220/833 |
| 2006/0000833 | A1 * | 1/2006 | Boots et al. | 220/254.3 |

* cited by examiner

Fig. 12
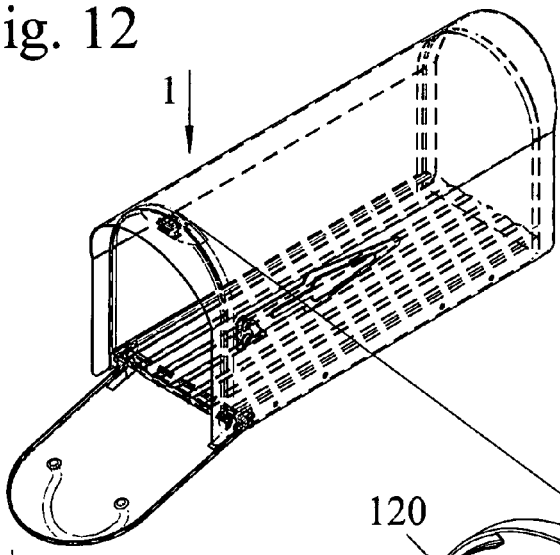
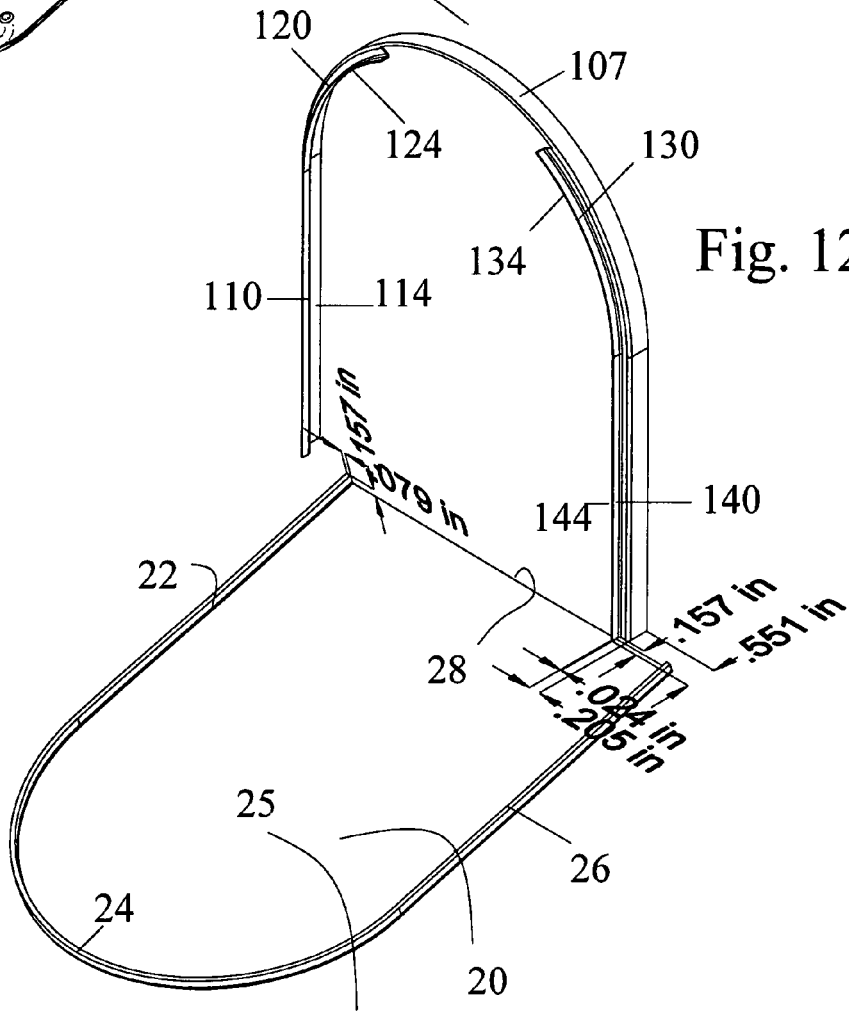
Fig. 12A

WEATHER BARRIER MAILBOX

BACKGROUND AND PRIOR ART

Outdoor mailboxes have been around for many years, and come in many sizes and shapes, and are exposed to all types of weather conditions. Popular types of mailboxes include an elongated compartment such as a rectangular housing with a flat roof or curved roof, and an access door that swings open, where the door must be able to close and remain closed, especially for protection from outside elements. Being exposed to varying outdoor weather conditions means that moisture and water of varying degrees are likely to enter into the boxes even with the door being closed. The water/moisture entry problem is further compounded during severe weather conditions, such as but not limited to rainstorms, snow storms, and the like.

Some mailboxes have doors that can partially but weakly seal the open end of the mail box by closing under a cowling to abut against an internal face, or "rain guard" lip. With such designs, it is common for water entering a mailbox with a conventional rainguard will tend to disperse or splatter the interior of the mailbox to varying degrees depending upon the severity of the external weather conditions. Water can pass into the mailbox during blowing rainstorms, where the internal lip edge does not block or control the water entering into the box. Current mailboxes also do not allow for water entering the interior to be controlled and released from the boxes. Instead splatter and puddles form inside of the mailboxes. Thus, mail type contents inside become damaged by being exposed to weather elements, where paper and cardboard items may become irreparably damaged.

Other types of mailboxes have exterior doors that wraps about an open end of a mailbox. Similarly, rainwater and the like, can easily be driven between a wrapped door edges into the mailbox. Also, these current mailboxes also do not allow for trapped water to be released from the boxes and instead become puddles inside of the mailboxes. Thus, mail type contents inside become damaged by being exposed to weather elements, where paper and cardboard items become irreparably damaged.

Still furthermore, these current mailbox doors will often fail to stay shut during rainstorms. An open mailbox is clearly prone to water intrusion that damages mail type contents. Failure to secure the mailbox door in a closed position will allow for the mailbox contents to become dislodged and lost, and even stolen overtime.

Still furthermore, mailboxes that allow for water intrusion have a reduced lifespan since the inside moisture and water can further more quickly deteriorate the box, by oxidation, rust, and the like.

Adding extra sealing materials such as weather stripping and the like, would be generally impractical. The cost of adding weather stripping and the like, with or without extra fasteners, can substantially raise the cost of inexpensive mailboxes making them impractical to be manufactured and sold. Still furthermore, weather stripping such as rubber and elastomeric material, would not last long due to extreme environmental conditions. For example, heat can act quickly and harshly, on seals and gaskets causing the materials to dry up, rot, and disintegrate. Self-stick adhesive materials can similarly dry out as well. Any added on material would also be prone to separate, peel, and/or fall off the box. Additionally, adding weather stripping by mechanical fasteners can further create manufacturing concerns that detract from the mailbox. Adding extra materials can potentially create snag hazards for clothes, in addition to possibly creating sharp edges that can scratch and puncture persons using the mailbox.

The inventor is not aware of apparatus, devices and methods that overcome all the problems listed above. Thus, the need exists for solutions to the above problems with the prior art.

SUMMARY OF THE INVENTION

A primary objective of the present invention is to provide a moisture resistant barrier mailbox apparatus, device and method for inhibiting water intrusion into mailboxes where the doors close under a cowling and into an open end of the mailbox.

A secondary objective of the present invention is to provide a moisture resistant barrier mailbox apparatus, device and method for inhibiting water intrusion into mailboxes where the doors close over the outer edges which wrap about open ends of the mailbox.

A third objective of the present invention is to provide a moisture resistant barrier mailbox apparatus, device and method for inhibiting water intrusion which also secures the door in a shut position that is not prone to easily reopen.

A fourth objective of the present invention is to provide a moisture resistant barrier mailbox apparatus, device and method for inhibiting water intrusion into mailboxes which reduces chances of mail type contents from becoming dislodged and lost, and stolen overtime.

A fifth objective of the present invention is to provide a moisture resistant barrier mailbox apparatus, device and method for inhibiting water intrusion into mailboxes that does not require extra parts such as weather stripping and/or extra fasteners.

A sixth objective of the present invention is to provide a moisture resistant barrier mailbox apparatus, device and method for inhibiting water intrusion into mailboxes and which allows for water and moisture inside of the box to not puddle, and instead to drain outside of the mailbox.

A seventh objective of the present invention is to provide a moisture resistant barrier mailbox apparatus, device and method for inhibiting water intrusion into mailboxes that helps extend the operational life of the mailbox.

The invention covers a moisture resistant barrier mailbox apparatus, device and method for inhibiting water intrusion into mailboxes where the doors wedge into open ends of the mailbox.

A preferred embodiment of a novel mailbox for receiving mail using the invention can include a chamber having an inside compartment and at least one open end, a channel groove about the one open end of the chamber, and a door pivotally attached to the open end of the chamber that swings from a closed position to an open position, wherein the door in the closed position has a portion that protrudes into the channel groove, and seals the inside compartment from water intrusion.

The channel groove can include a left channel groove along a left front wall to the open end, and a right channel groove along a right front wall to the open end of the mailbox. The left channel groove and the right channel groove can each include upper curved portions.

The mailbox can further include at least one a through-hole opening in a floor of the mailbox adjacent to the open end for allowing water to drain outside of the mailbox. For example, the mailbox can include a left through-hole opening in a floor of the mailbox adjacent to the left channel groove for allowing water to drain outside of the mailbox, and/or a right through-hole opening in a floor of the mailbox adjacent to the right channel groove for allowing water to drain outside of the mailbox.

The mailbox door can include inwardly bent outer edges for allowing the door to partially close under a cowling into the open end of the mailbox, wherein the inwardly bent outer edges fit into the channel groove when the door is in the closed position.

The door can include a pair of inwardly bent outer edges, wherein one of the inwardly bent outer edges fits into the channel groove when the door is in the closed position, and an outer inwardly bent outer edge wraps about and outside to the open end of the chamber.

The mailbox chamber, the channel groove and the door can be formed from metal. The mailbox chamber, the channel groove and the door can be formed from plastic.

The mailbox can further include a second channel groove about another open end of the chamber, and a second door pivotally attached to the second open end of the chamber that swings from a closed position to an open position, wherein the second door in the closed position has a portion that protrudes into the second channel groove, and seals the inside compartment from water intrusion.

The channel groove can include an inner portion that allows for the door to have a snap fit when in the closed position.

Another embodiment of the mailbox can include a chamber having an inside compartment and at least one open end, a left channel groove along a left front wall to the open end, the left channel groove having an upper inwardly curved portion, a right channel groove along a right front wall to the open end, the right channel groove having an upper inwardly curved portion, a door pivotally attached to the open end of the chamber that swings from a closed position to an open position, the door having inwardly bent outer edges, wherein the inwardly bent outer edges of the door protrudes into the channel groove when the door is in the closed position, and seals the inside compartment from water intrusion.

The mailbox door can include a single inwardly bent outer edge that allows the door to partially wedge into the open end of the chamber. The inwardly outer edge can include a pair of inwardly bent outer edges being parallel to one another, wherein an outer inwardly bent outer edge wraps about and outside to the open end of the chamber.

Further objects and advantages of this invention will be apparent from the following detailed description of the presently preferred embodiments which are illustrated schematically in the accompanying drawings.

BRIEF DESCRIPTION OF THE FIGURES

FIG. 12 is a partial exposed view of the inside of the mailbox.

FIG. 12A is an enlarged view of the novel channel grooves and door edges.

DESCRIPTION OF THE PREFERRED EMBODIMENTS

Figure 1:
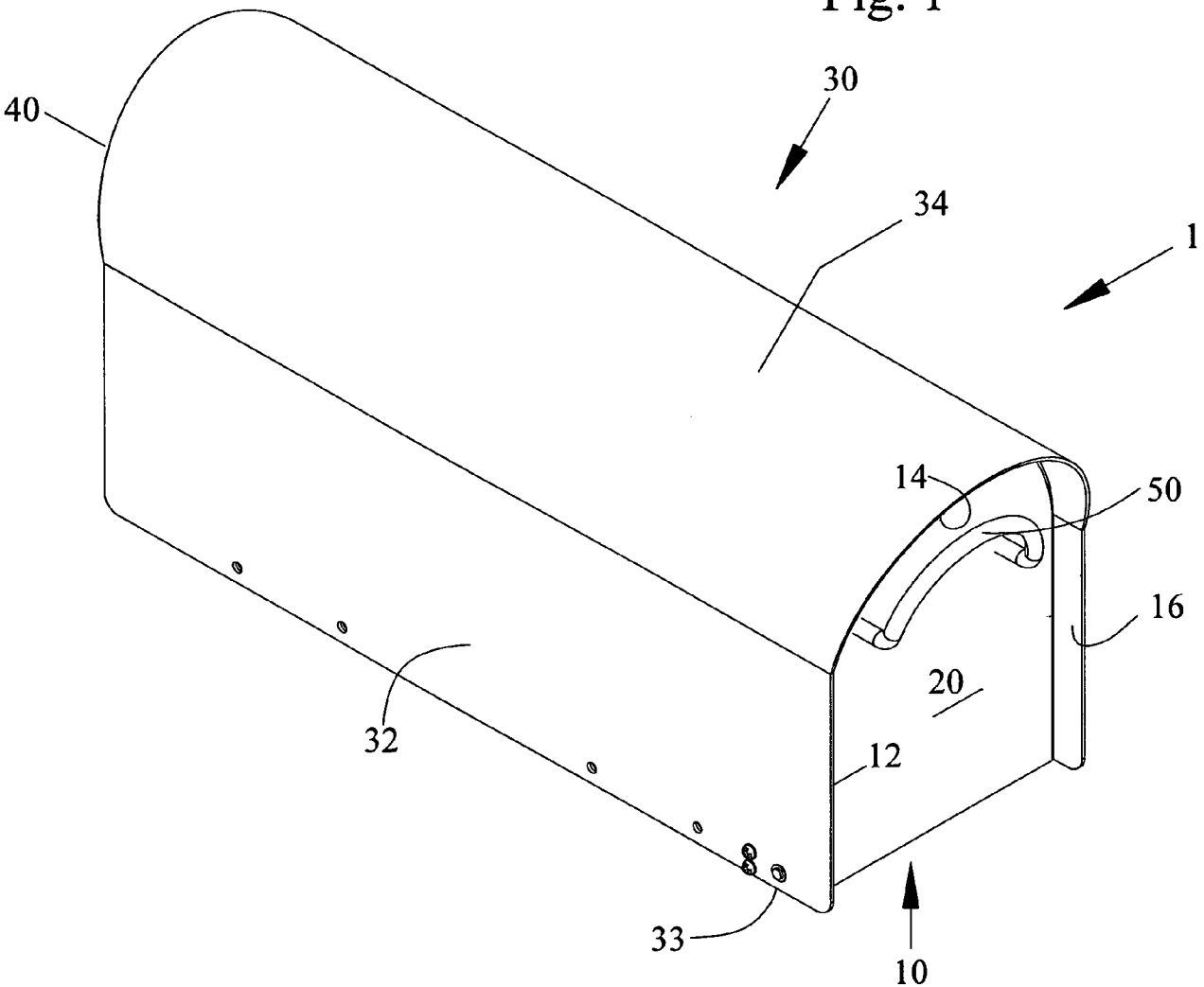
FIG. 1 is a perspective left front end view of a mailbox with the invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Mailbox 1
Front end of mailbox 10
Left front end wall 12
Curved front top roof 14 (with front cowling end)
Right front end wall 16
Mailbox door 20
Left side inwardly protruding door edge 22
Curved roof inwardly protruding door edge 24
Right side inwardly protruding door edge 26
Flat bottom edge of door 28
Main chamber of mailbox 30
Left wall of main chamber 32
Left lower hanging sidewall 33
Roof of main chamber 34
Right wall of main chamber 34
Right wall of main chamber 36
Right lower hanging sidewall 37
Floor with parallel longitudinal indentations 38 (can slope forward for drainage)
Rear end of mailbox 40
Handle for mailbox 50

Left pivot hinge 62
Fasteners for attaching pivot hinged to both door and lower left front end of mailbox 63
Right pivot hinge 66
Fasteners for attaching pivot hinge to both door and lower right front end of mailbox 67
Flag 70
Drainage channel grooves 100
Flat C-shaped longitudinal base plate/band 104
Left side channel groove 110
Left bent flange 114
Upper left roof curved channel groove 120
Upper left bent flange 124
Upper right roof curved channel groove 130
Upper right bent flange 134
Right side channel groove 140
Right bent flange 144
Door mount flange on mailbox front end roof 150
Door closer magnet 155
Optional Vibration and Sound absorbing and dampening weather strip 190
Mailbox with door that wraps about outside of front end 200
Open end 210
Wrapping door 220
Left side inwardly protruding door edge 222A
Outer left side inwardly protruding door edge 22B
Curved roof inwardly protruding door edge 224A
Outer curved roof inwardly protruding door edge 224B
Right side inwardly protruding door edge 226A
Outer curved roof inwardly protruding door edge 226B
Chamber 230
Left wall of main chamber 232
Left lower hanging sidewall 233
Roof of main chamber 234
Right wall of main chamber 236
Right lower hanging sidewall 237
Floor with parallel longitudinal indentations 238 (can slope forward for drainage)
Door handle 250
Left door hinge 262
Right door hinge 266
Left side channel groove 310
Upper left roof curved channel groove 320
Upper right roof curved channel groove 330
Right side channel groove 340

Figure 2:
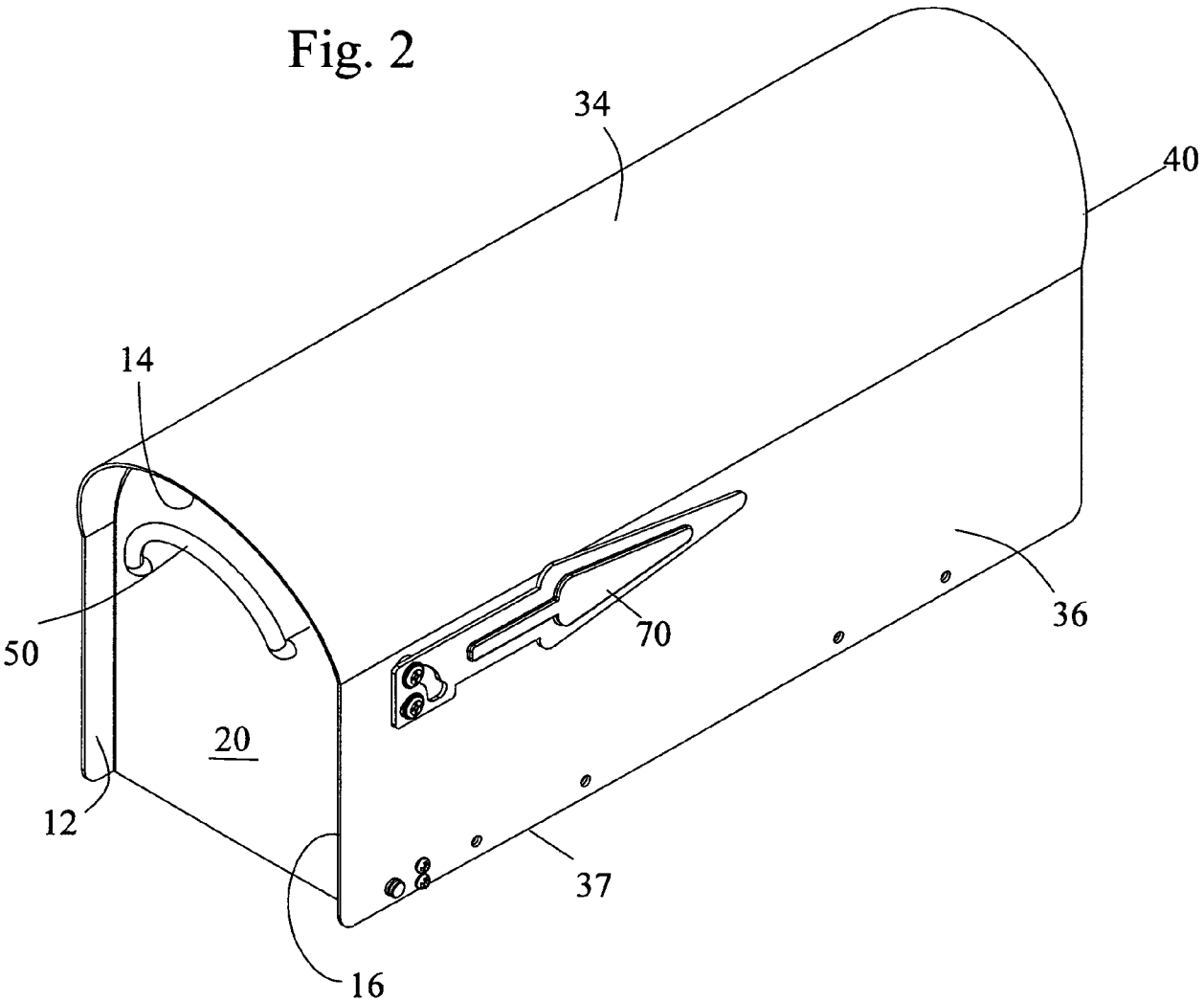
FIG. 2 is a perspective right front end view of the mailbox of FIG. 1.
Figure 3:
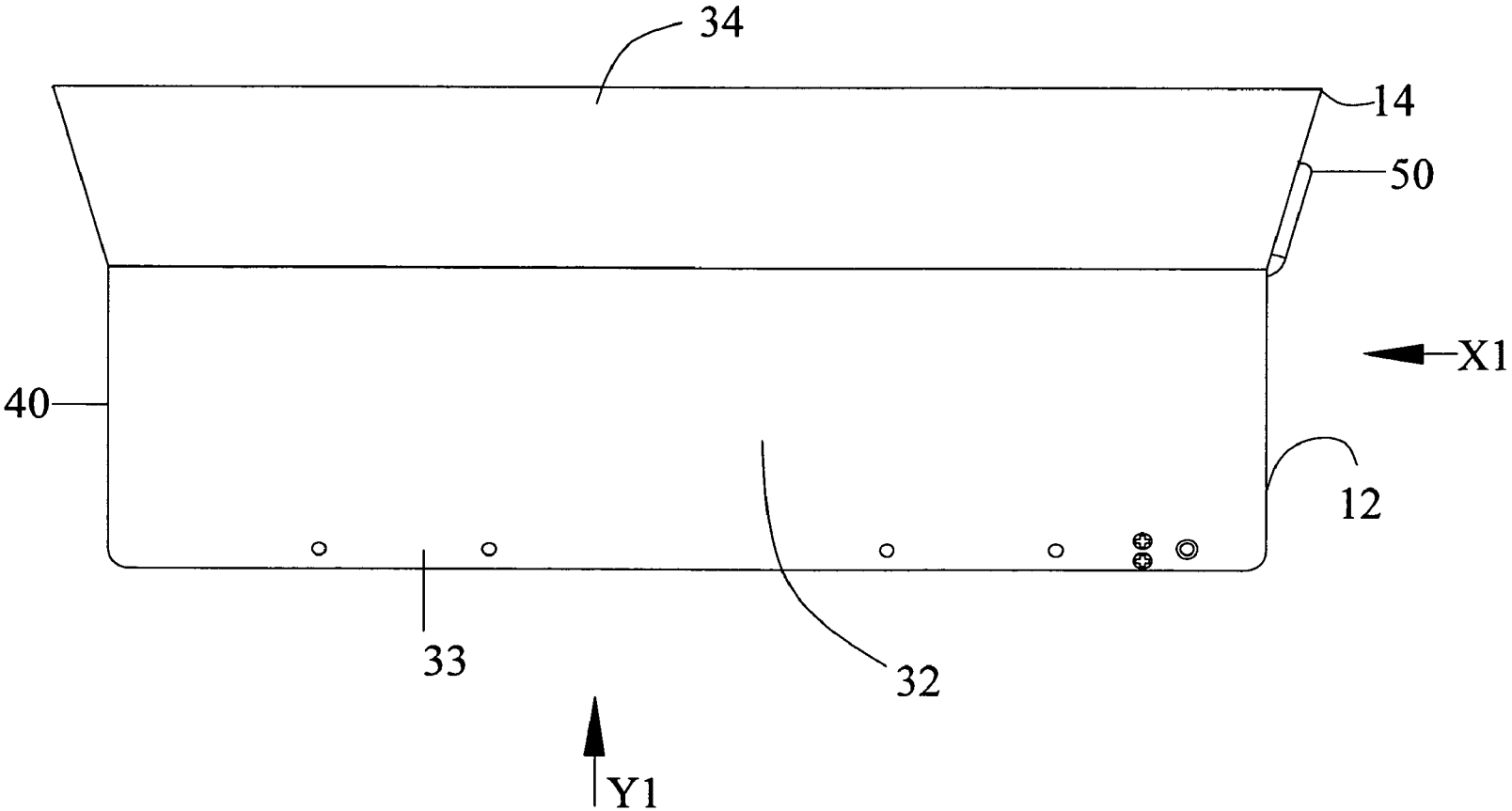
FIG. 3 is a right side view of the mailbox of FIG. 1.
Figure 4:
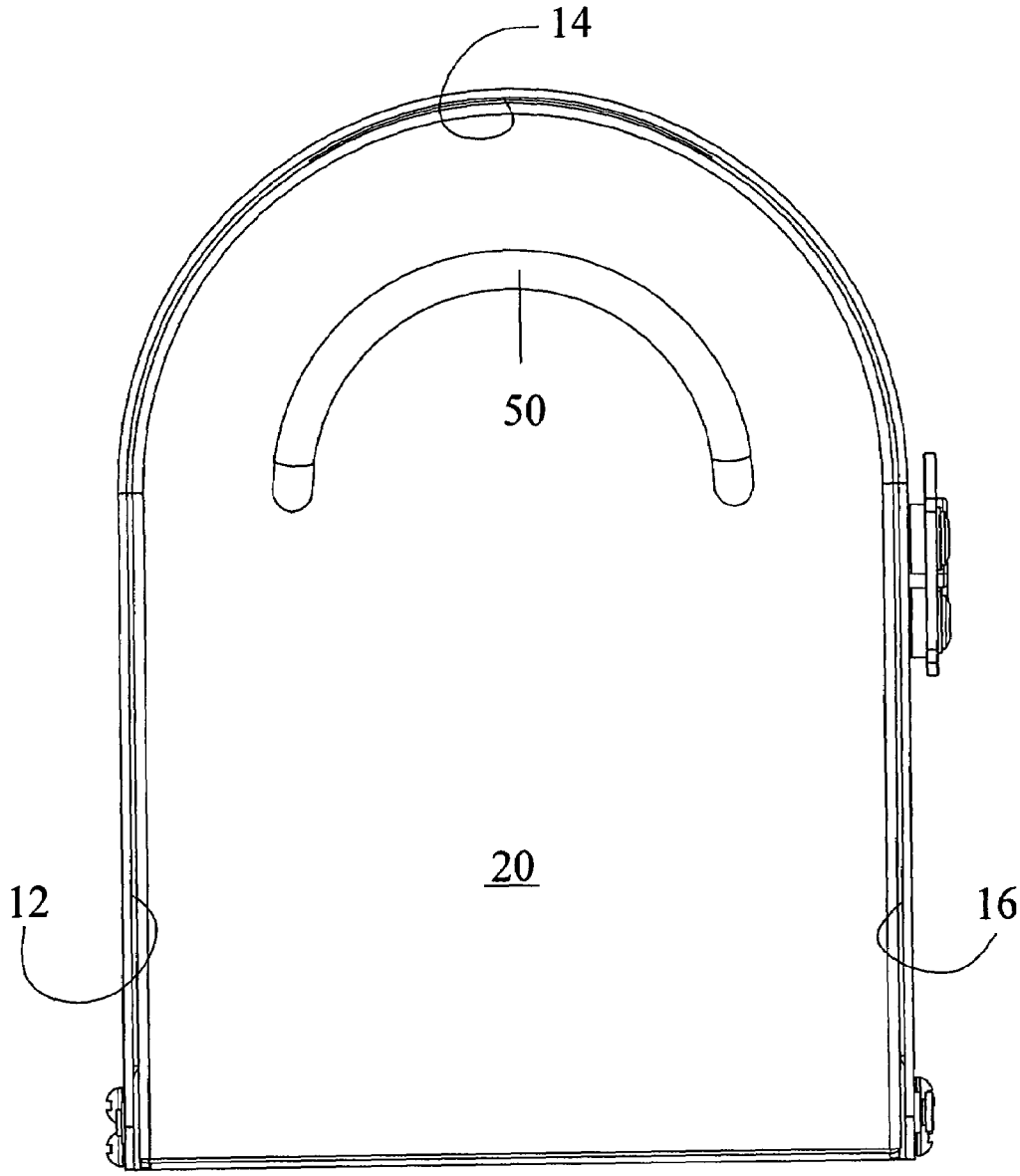
FIG. 4 is a front end view of the mailbox of FIG. 3 along arrow X1.
Figure 5:
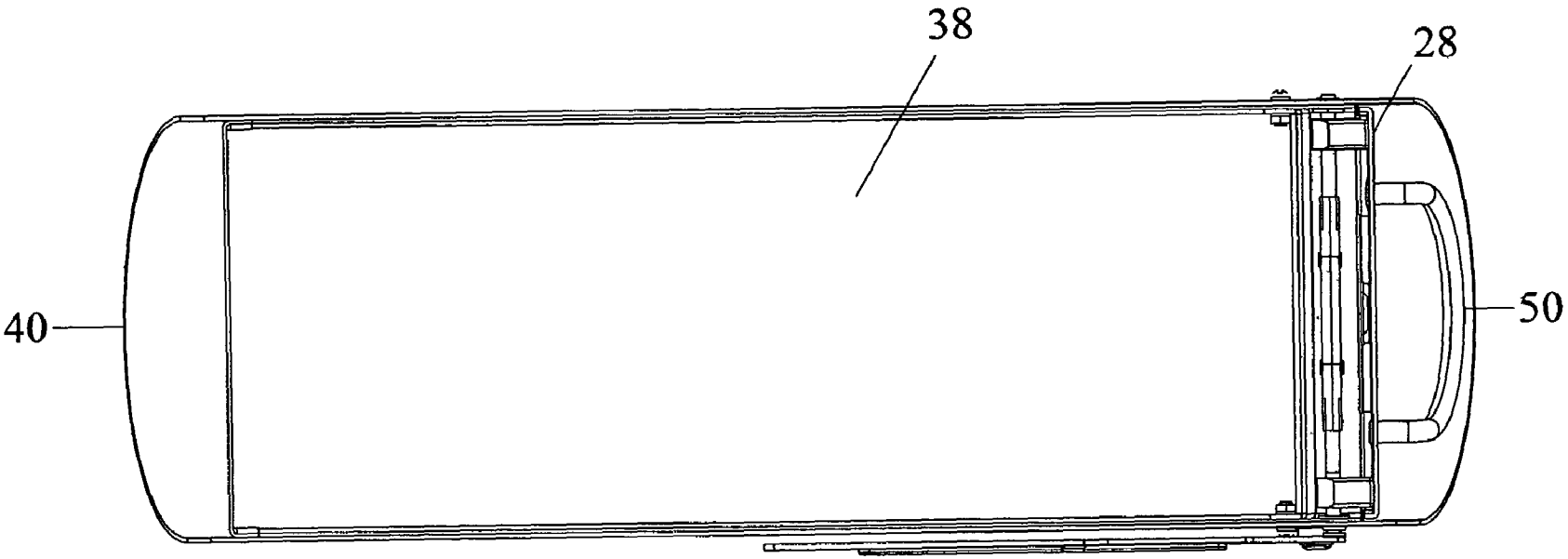
FIG. 5 is a bottom view of the mailbox of FIG. 3 along arrow Y1.

FIG. 1 is a perspective left front end view of a mailbox 1 with the invention. FIG. 2 is a perspective right front end view of the mailbox 1 of FIG. 1. FIG. 3 is a right side view of the mailbox 1 of FIG. 1. FIG. 4 is a front end view of the mailbox 1 of FIG. 3 along arrow X1. FIG. 5 is a bottom view of the mailbox 1 of FIG. 3 along arrow Y1.

Referring to FIGS. 1-5, the closed mailbox 1 can include an exterior having a front end 10, with a door 20 with handle 50 that closes into part of the front end 10 (under a cowling type roof edge) of the mailbox 1, a main chamber 30, and rear end 40. The front end 10 of the mailbox 1, can include an outwardly extending left front end wall 12, an outwardly extending curved front top roof 14, and an outwardly extending right front end wall 16, each of which can extend out from the closed door 20. The novel features of the door 20 will be described in more detail with the FIGS. 6-11 showing the door 20 in an open position. A flag 70 can be attached to side wall 36 and can pivot up and down similar to those on existing mailboxes. The components of the mailbox 1 can be made from metal such as aluminum, galvanized steel, and the like, with the metal having a powder coated finish.

Figure 6:
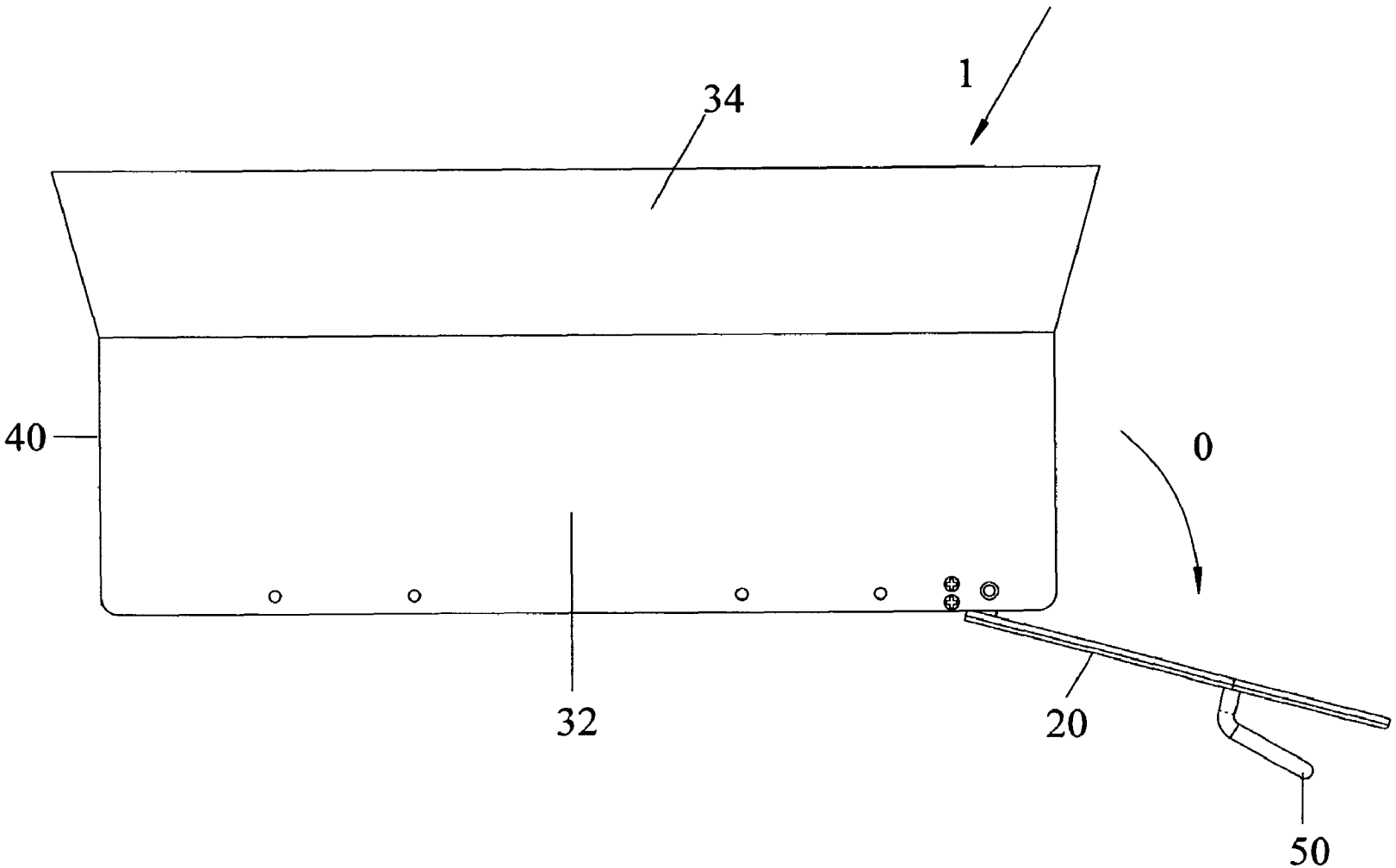
FIG. 6 is a right side view of the mailbox of FIG. 3 with door open.
Figure 7:
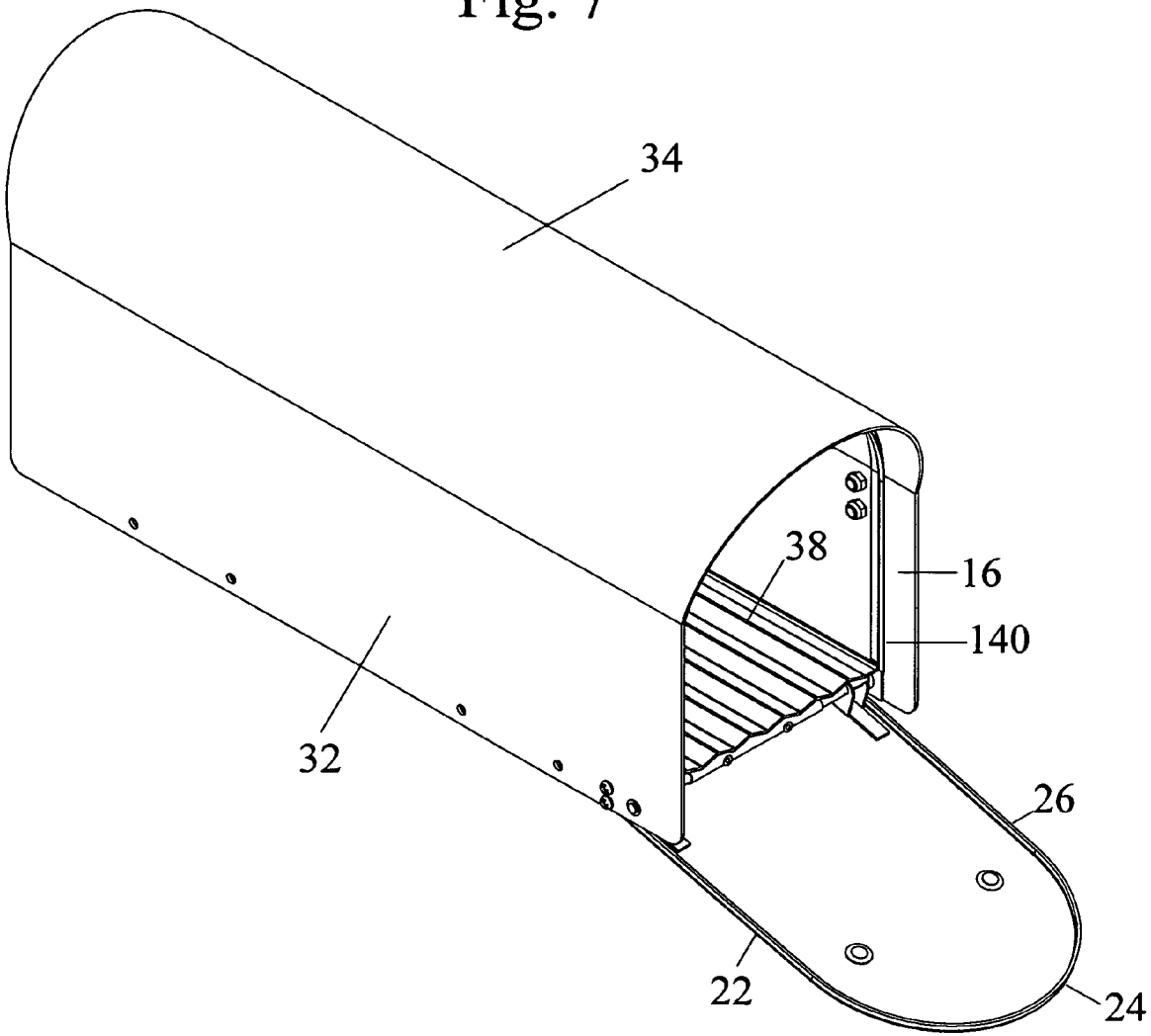
FIG. 7 is another perspective left front end view of the mailbox of FIG. 1 with open door.
Figure 8:
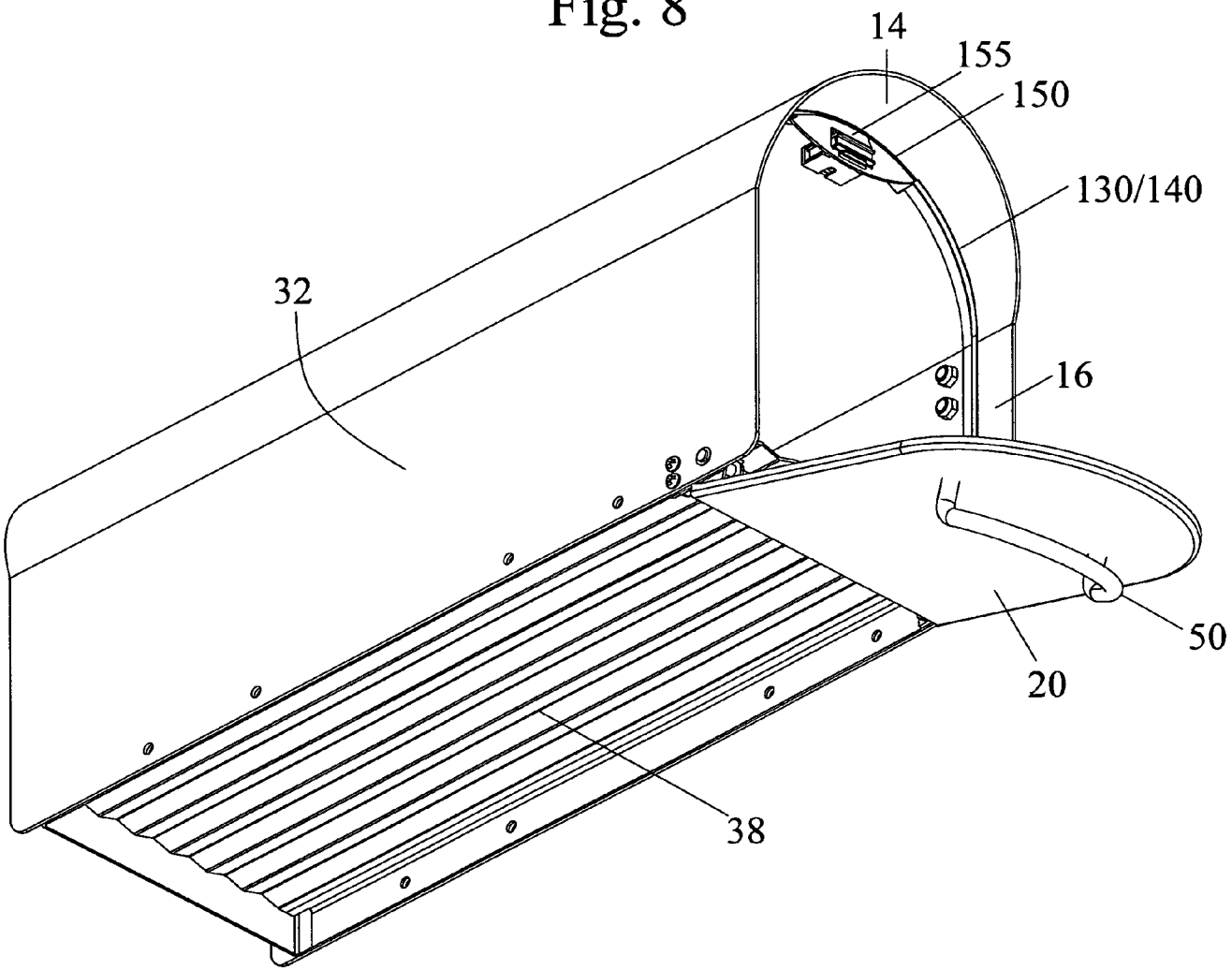
FIG. 8 is a perspective lower left front end view of the mailbox with open door of FIG. 7.
Figure 9:
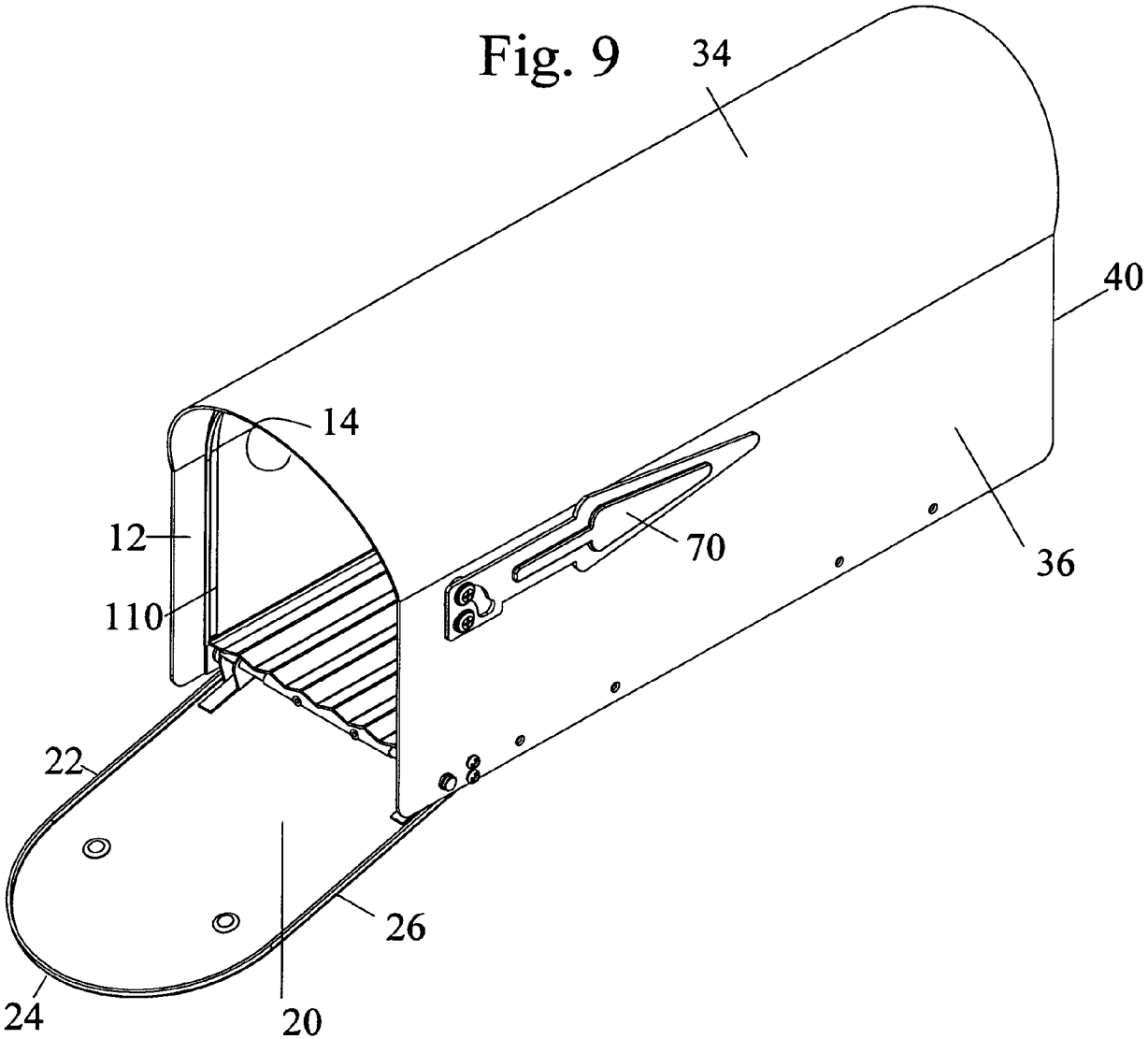
FIG. 9 is a perspective right front end view of the mailbox of FIG. 2 with door open.
Figure 10:
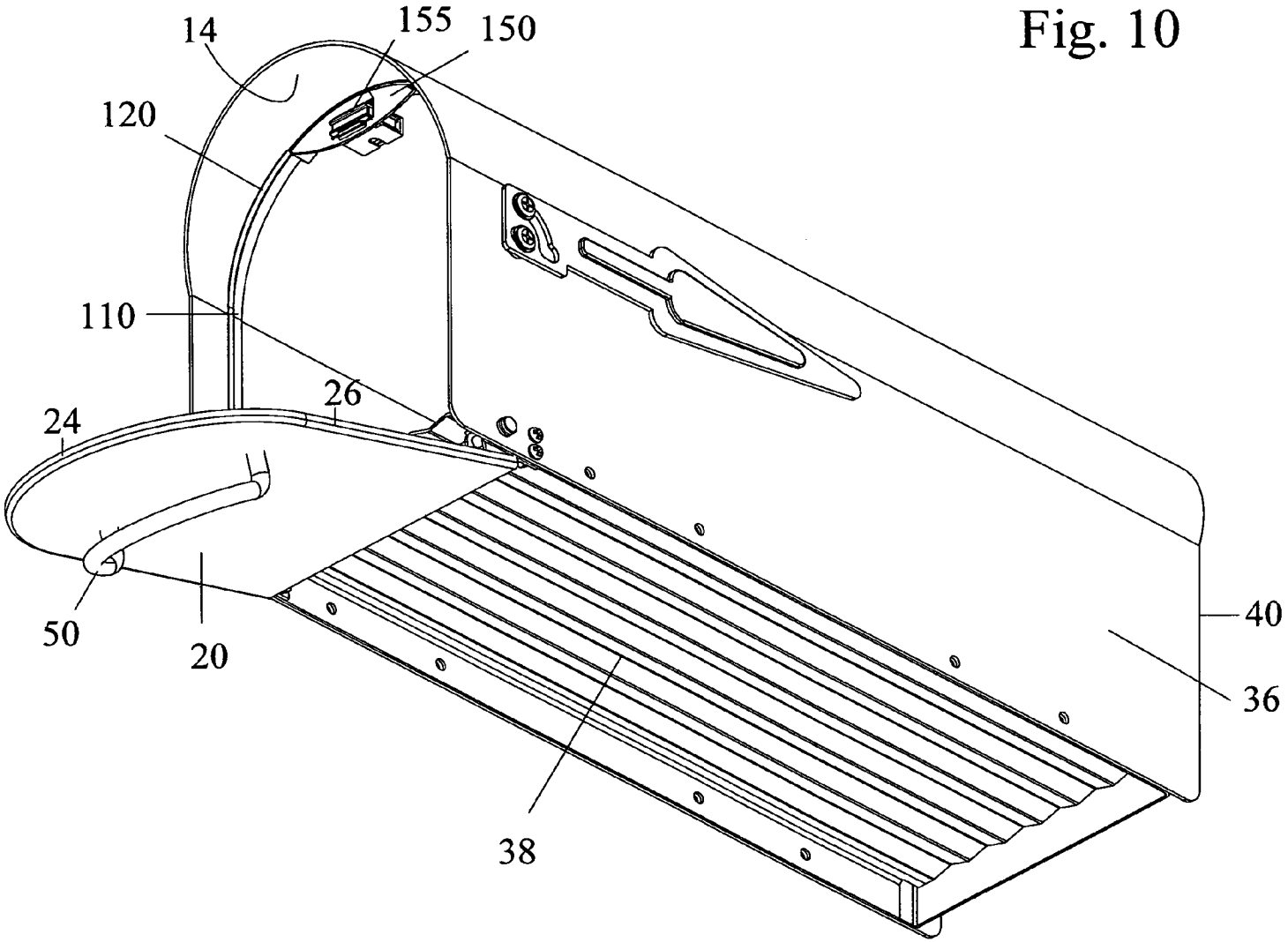
FIG. 10 is a perspective lower right front end view of the open door mailbox of FIG. 9.
Figure 11:
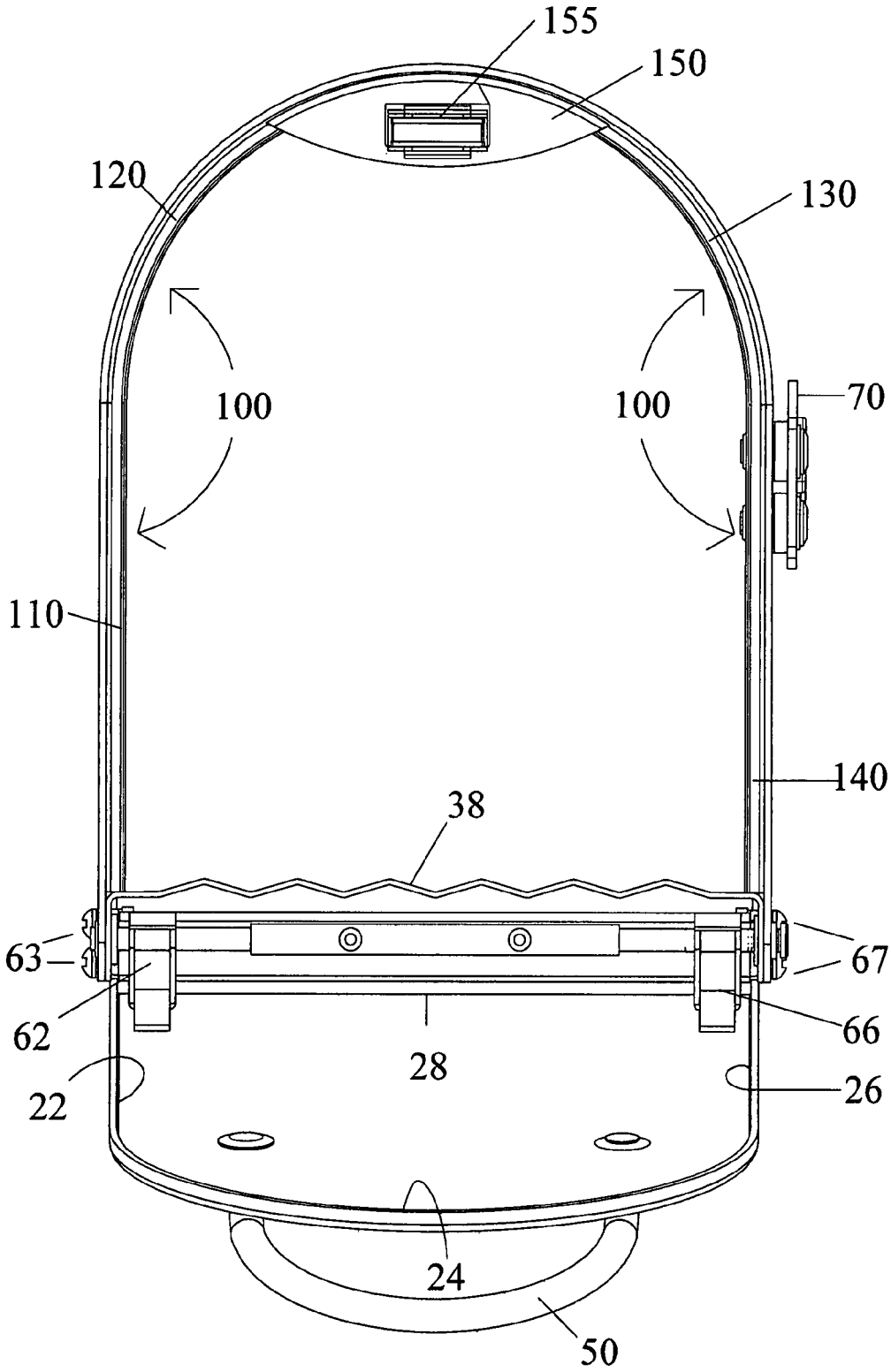
FIG. 11 is a front end view of the mailbox of FIG. 4 with open door.
Figure 13:
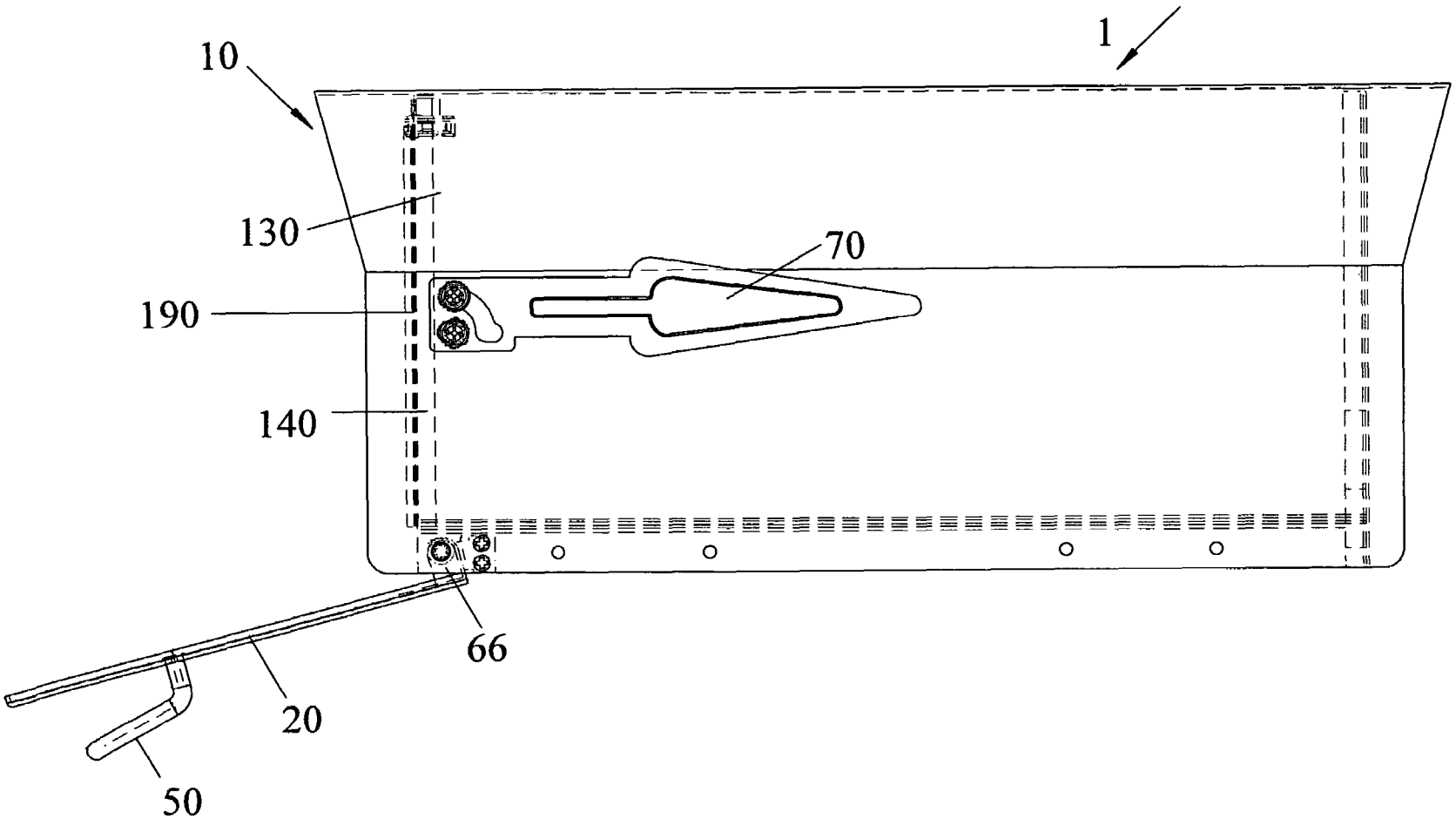
FIG. 13 is a right side partial cross-sectional view of the mailbox with door open.

FIG. 6 is a right side view of the mailbox 1 of FIG. 3 with door 20 open. FIG. 7 is another perspective left front end view of the mailbox 1 of FIG. 1 with open door 20. FIG. 8 is a perspective lower left front end view of the mailbox 1 with open door 20 of FIG. 7. FIG. 9 is a perspective right front end view of the mailbox 1 of FIG. 2 with door 20 open. FIG. 10 is a perspective lower right front end view of the open door 20 of the mailbox 1 of FIG. 9. FIG. 11 is a front end view of the mailbox 1 of FIG. 4 with open door 20. FIG. 12 is a partial exposed view of the inside of the mailbox 1. FIG. 12A is an enlarged view of the novel channel grooves 100 and door edges 22, 24 and 26. FIG. 13 is a right side partial cross-sectional view of the mailbox 1 wit door 20 open.

Figure 14:
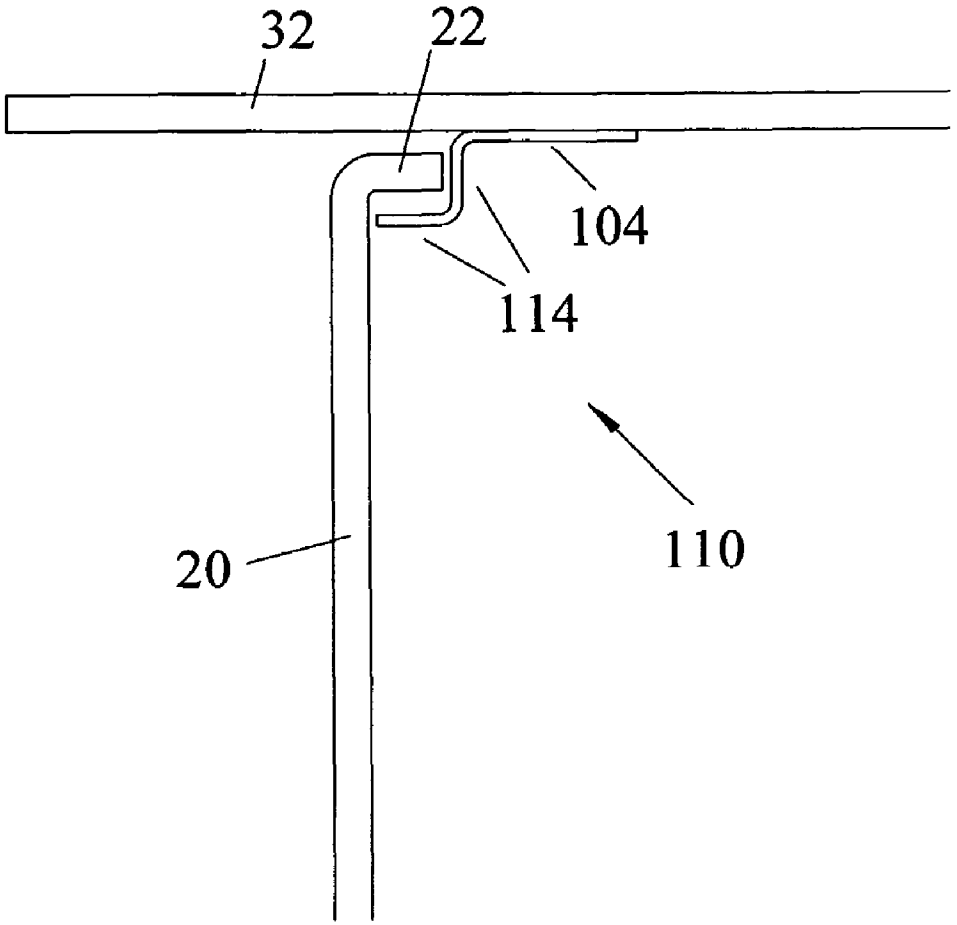
FIG. 14 is an enlarged cross-sectional view of an angled door edge in a channel groove.

FIG. 14 is an enlarged cross-sectional view of an angled door edge 22 in a channel groove 110 formed by bent metal flange 114 and flat C-shaped longitudinal band 104, when the door 20 is in a closed position with the mailbox 1.

Referring to FIGS. 1-14, the door 20 can be opened by pulling handle outward in the direction of arrow O. The door 20 can be attached to the main chamber 30, by a left pivot hinge 62. Fasteners 63, such as but not limited to screws, and the like, can be used for attaching the left pivot hinge 62 to both the lower left portion of the door 20 and the lower left front end 12/33 of the mailbox chamber 30. The lower right portion of the door 20 can be attached to the lower right front end 16/37 of the chamber 30 by a right pivot hinge 66 and fasteners 67, such as but not limited to screws, and the like.

The door 20 can be closed by moving the handle 50 with the door 20 backward in the direction of arrow O, so that magnet 155 on a door mount flange on mailbox front end roof 150, is close enough to attract an upper metal interior surface portion of the metal door 20 which keeps the door 20 in a closed position.

The floor 39 of the mailbox 1 can have parallel longitudinal indentations 38 that can slope forward to enhance any drainage of water and moisture that may get into the mailbox 1, if and when the door 20 is opened during rainstorms, and other wet conditions, and the like. The floor can be horizontal or partially sloped or tilted to the open end of the mailbox to enhance drainage effects if water gets inside.

Referring to FIGS. 7-13, about the front end 10 of the mailbox 1 and behind the outwardly protruding front end walls 12, 14 and 16 can be drainage channel grooves 100. The drainage grooves 100 can include a left side channel groove 110 positioned inside of the front of left side wall 32 of the mailbox 1. The left side channel groove 110 can be formed from a bent metal flange 114 that attaches to a flat C-shaped longitudinal base plate/band 104, forming a U shaped groove therebetween.

The drainage grooves 100 can further include an upper left roof curved channel groove 120 and an upper right curved channel groove 130 both positioned inside the front of roof 34 of the mailbox 1. The upper left and right roof curved channel grooves 120, 130 can be formed from bent metal flanges 124, 134 that attach to the flat C-shaped longitudinal base plate/band 104 forming a U-shaped groove therebetween. A space can exist between the upper left curved channel groove 102 and the upper right curved channel groove 130 to allow for the magnet 155 and mount 150.

The drainage grooves 100 can further include a right side channel groove 140 positioned inside the front of right side wall 36 of mailbox 1. The right side channel groove 140 can be formed from a bent metal flange 144 that attaches to the flat C-shaped longitudinal base plate/band 104, forming a U-shaped groove therebetween.

The channel grooves 110, 120, 130, and 140 can be attached inside the front end 10 of mailbox 1, by welding the flat C-shaped longitudinal base plate/band 104 to the inside of the mailbox 1. Alternatively, the base plate 104 can be attached by fasteners such as but not limited to rivets, screws, and the like.

As described, the channel grooves 110, 120, 130, and 140 can have U-cross-sectional shapes, with groove widths of approximately 0.205 inches to allow for water drainage in that space, with the wall thickness of the metal being approximately 0.024 inches thick, and the depth of the grooves 110, 120, 130 and 140 can be approximately 0.551 inches. The bent metal flanges 114, 124, 134 and 144 can extend outward approximately 0.157 inches from the flat C-shaped longitudinal base plate/band 104.

Referring to FIGS. 7-13, the mailbox door 20 can include a left side inwardly angled door edge 22, a curved roof inwardly angled door edge 24, and a right side inwardly angled door edge 26, with the bottom edge of door 20 being flat. The inwardly angled edges 22, 24, 26 can be formed from bent edges of the door 20, and/or be stamped edges, and the like. The flat bottom edge 28 of the door 20 can be spaced apart and be in front of the floor 39 of the mailbox 1. The inwardly angled door edges 22, 24 and 26 can be approximately 0.079 inches thick, and can extend inwardly approximately 0.157 inches from the base 25 of the door 20.

The size of the inwardly angled door edges 22, 24 and 26 allow for a snug fit into the channel grooves 110, 120, 130 and 140, so that any moisture or water being driven toward the front closed front door 20 can become trapped outside of the chamber 30 and only drain by gravity downward to escape out the drain openings that are formed underneath the left and right channel grooves 110, and 140 that extend in front of the floor 38 of the mailbox 1. Additionally, other through-holes can be formed in the floor 38 to allow for additional drainage.

Alternatively, the angled door edges 22, 24 and 26 of the door 20 can have a slightly loose fit, which still allows for drainage since moisture and water would still run down the channel grooves 110-140 by gravity.

Still furthermore, an optional weather strip or silicon seal, and the like, 190, such as but not limited to rubber type gasket, elastomeric and the like, can be inserted into some or all of the channel grooves to also enhance the waterproof seal between the outside of the door and the inside of the main chamber 30. Additionally, the weather stripping could provide both sound and impact vibration dampening effects when the door is closed.

Mailbox With Door That Wraps About Open End of Mailbox

The preceding embodiment generally describes the invention with doors that fit into the open ends of the mailbox chamber to rest in a closed position underneath a protective overhang portion. The invention can also work with mailboxes that have doors with edges that wrap about the outer opening end of the mailbox itself.

Figure 15:
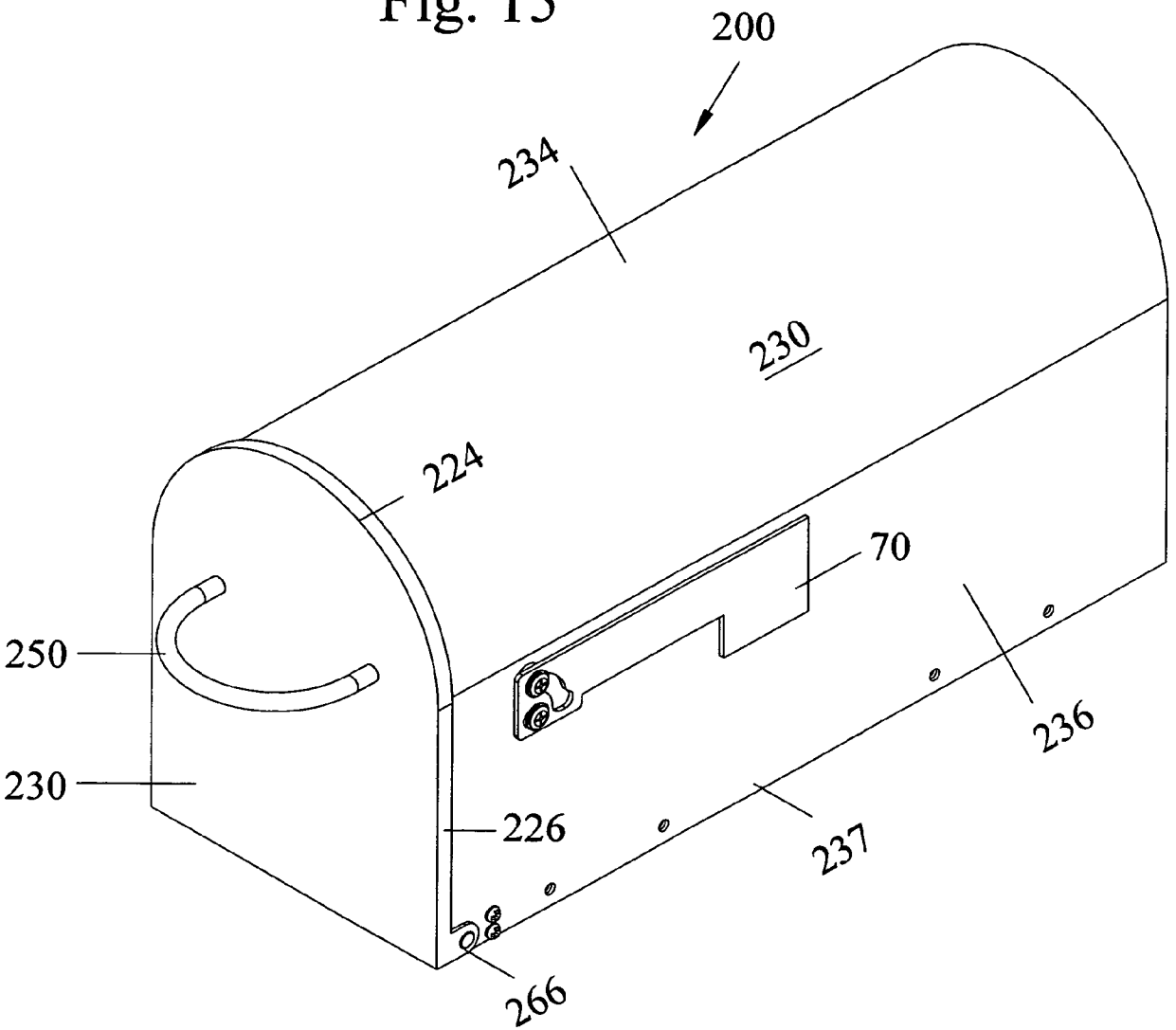
FIG. 15 is a perspective right front view of a wrapping door for the mailbox invention.
Figure 16:
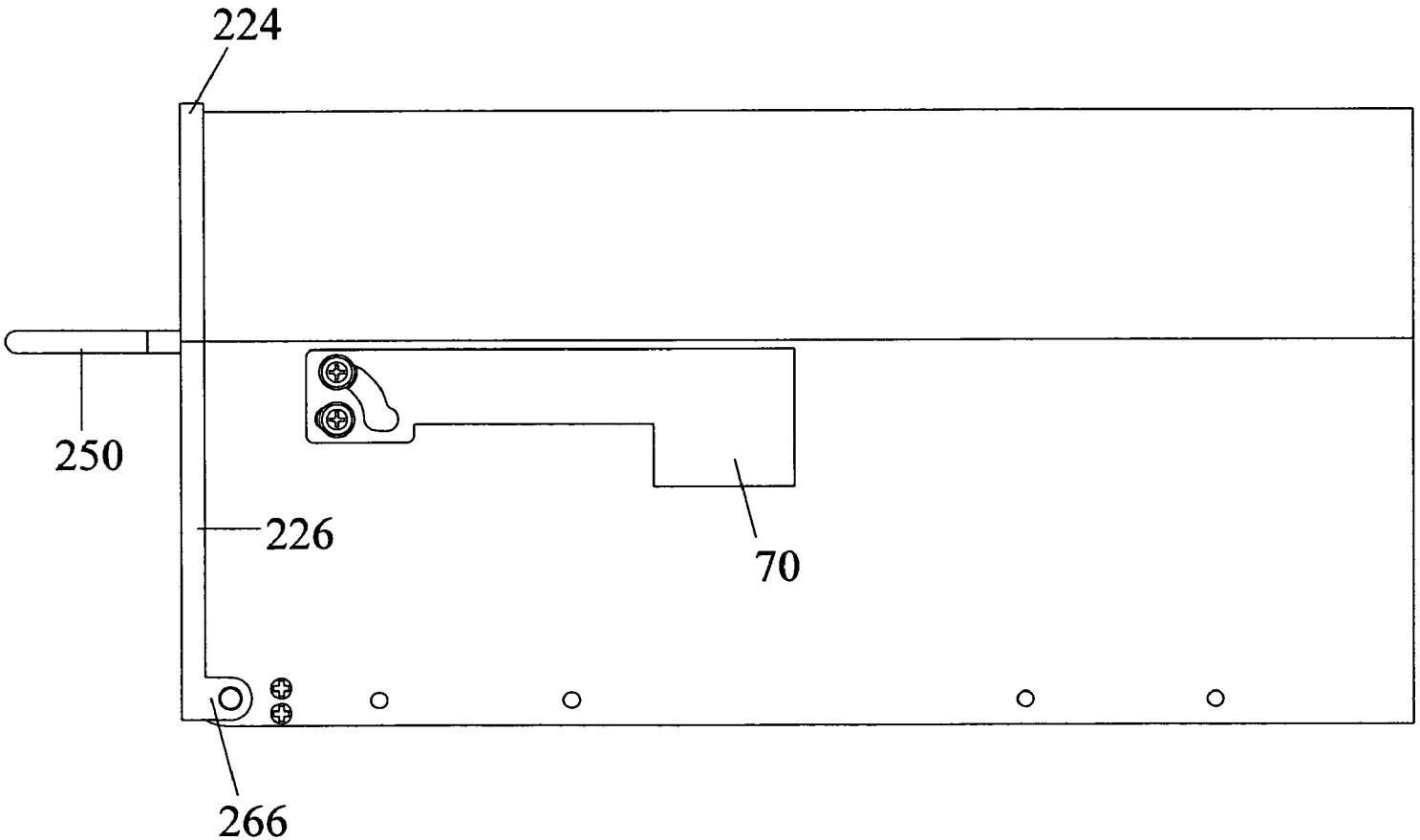
FIG. 16 is a right side view of the mailbox and closed door of FIG. 15.
Figure 17:
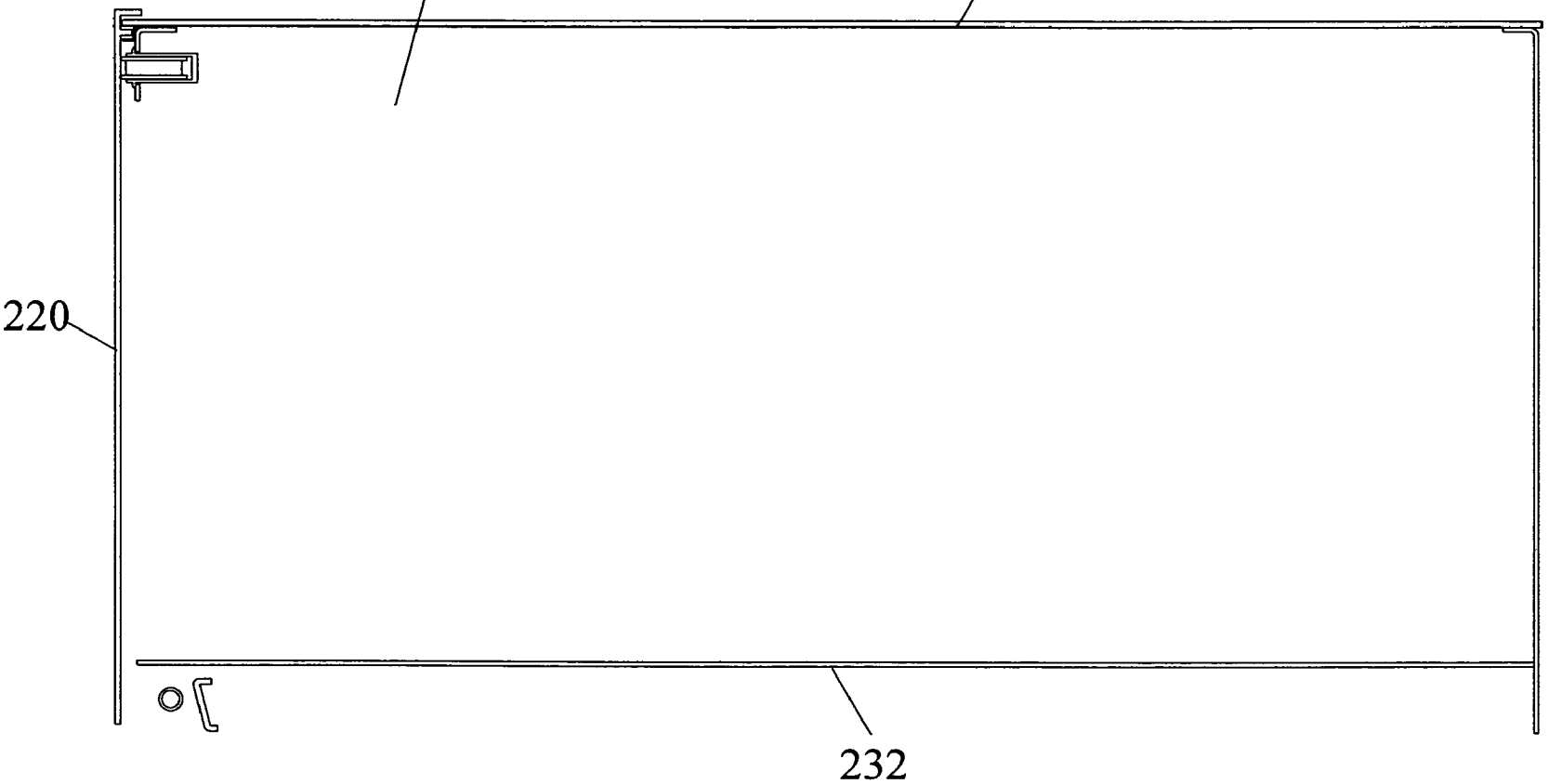
FIG. 17 is a bottom view of the mailbox and closed door of FIG. 15.
Figure 18:
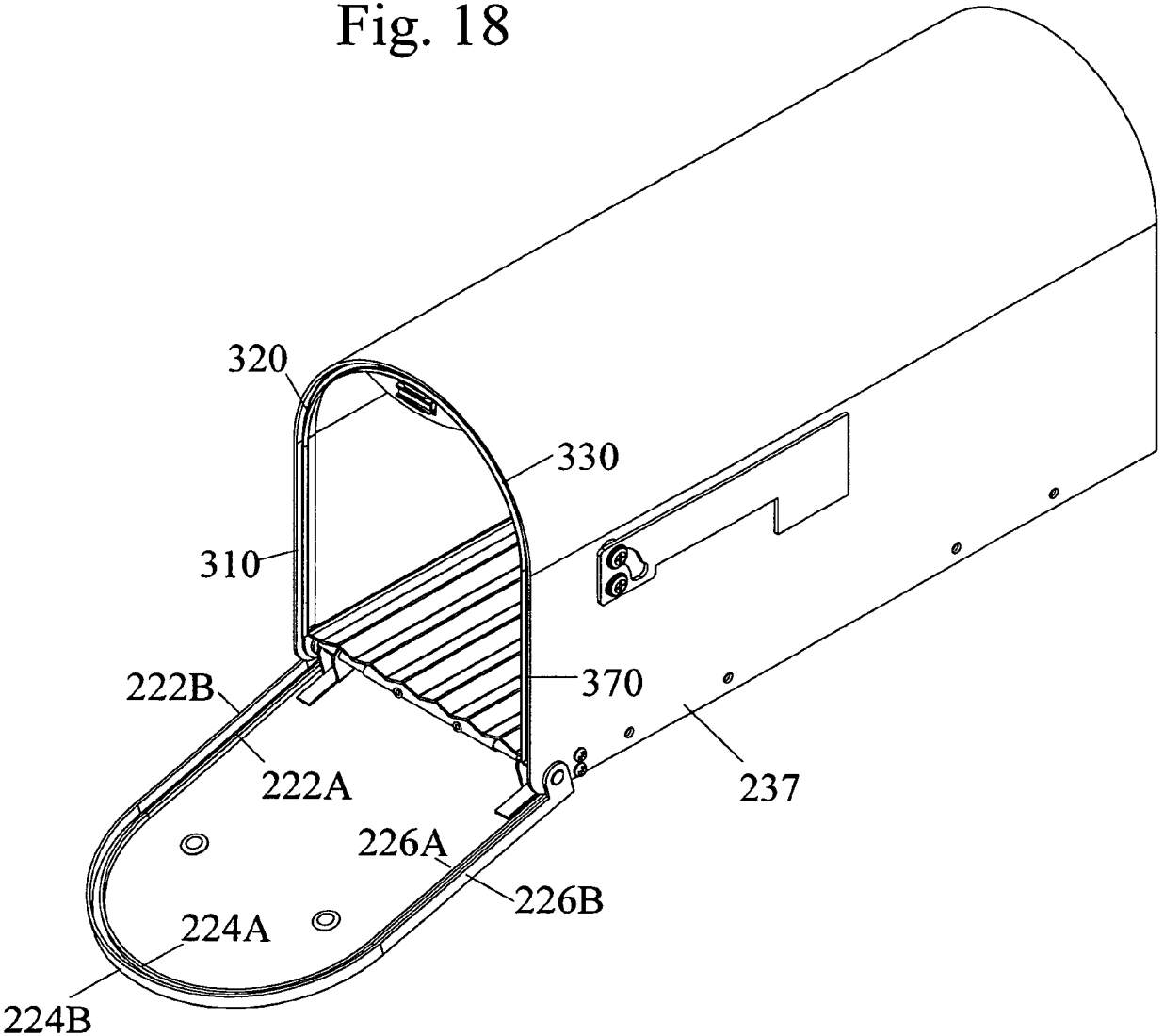
FIG. 18 is another perspective right front view of the mailbox of FIG. 15 with door open.
Figure 19:
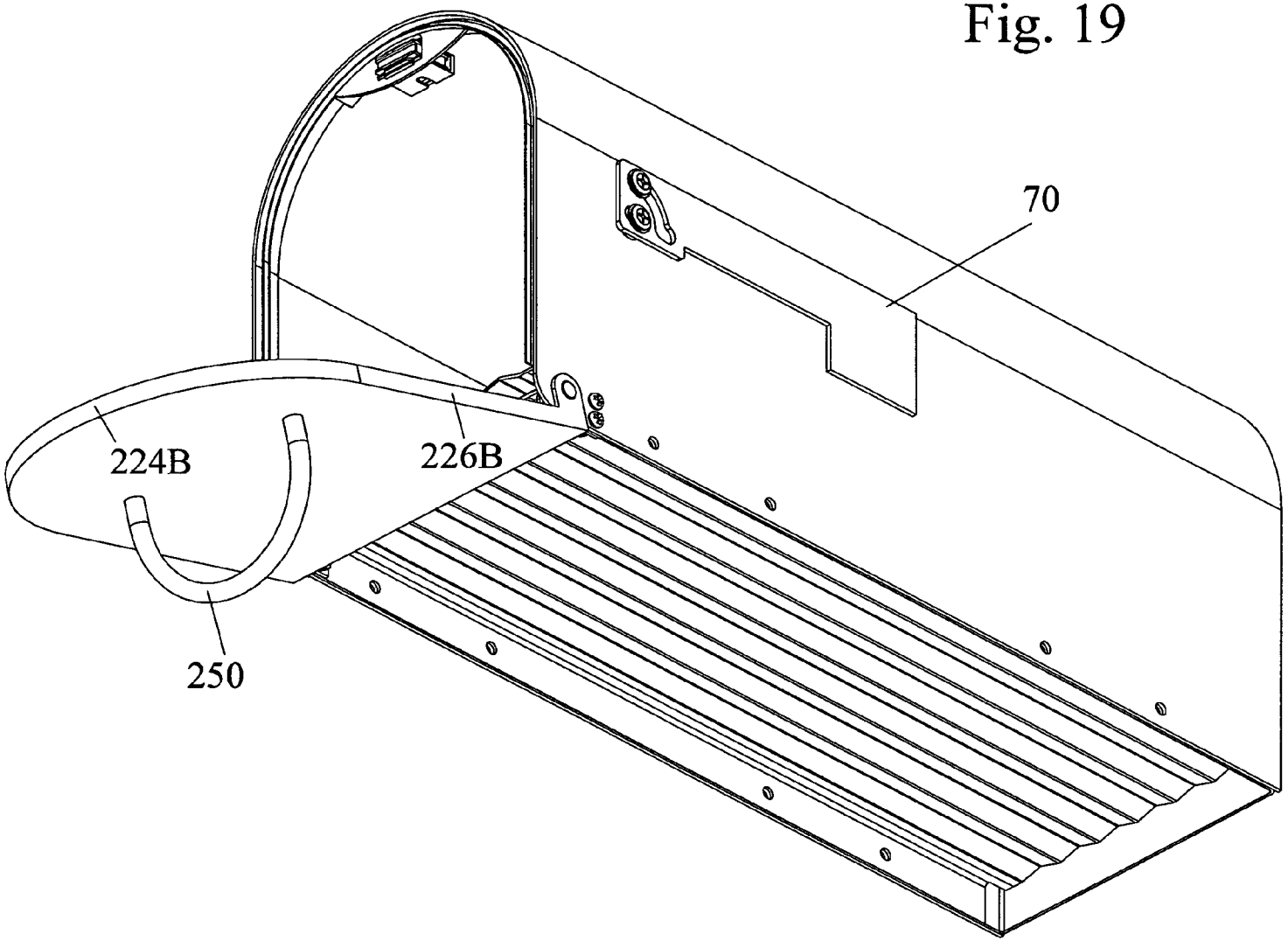
FIG. 19 is a perspective right lower front view of the mailbox of FIG. 18 with door open.
Figure 20:
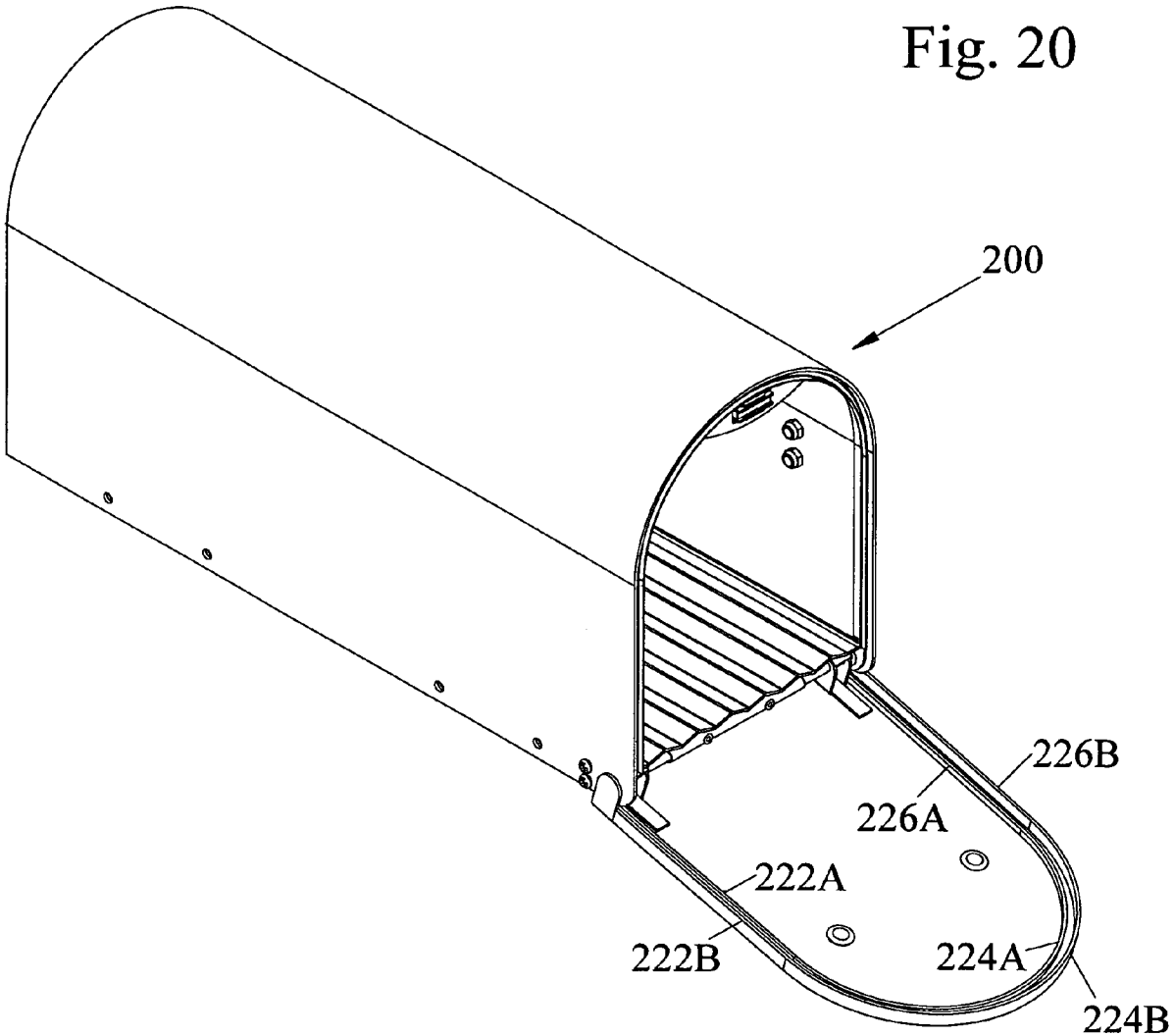
FIG. 20 is a perspective left front view of the mailbox of FIG. 15 with door open.
Figure 21:
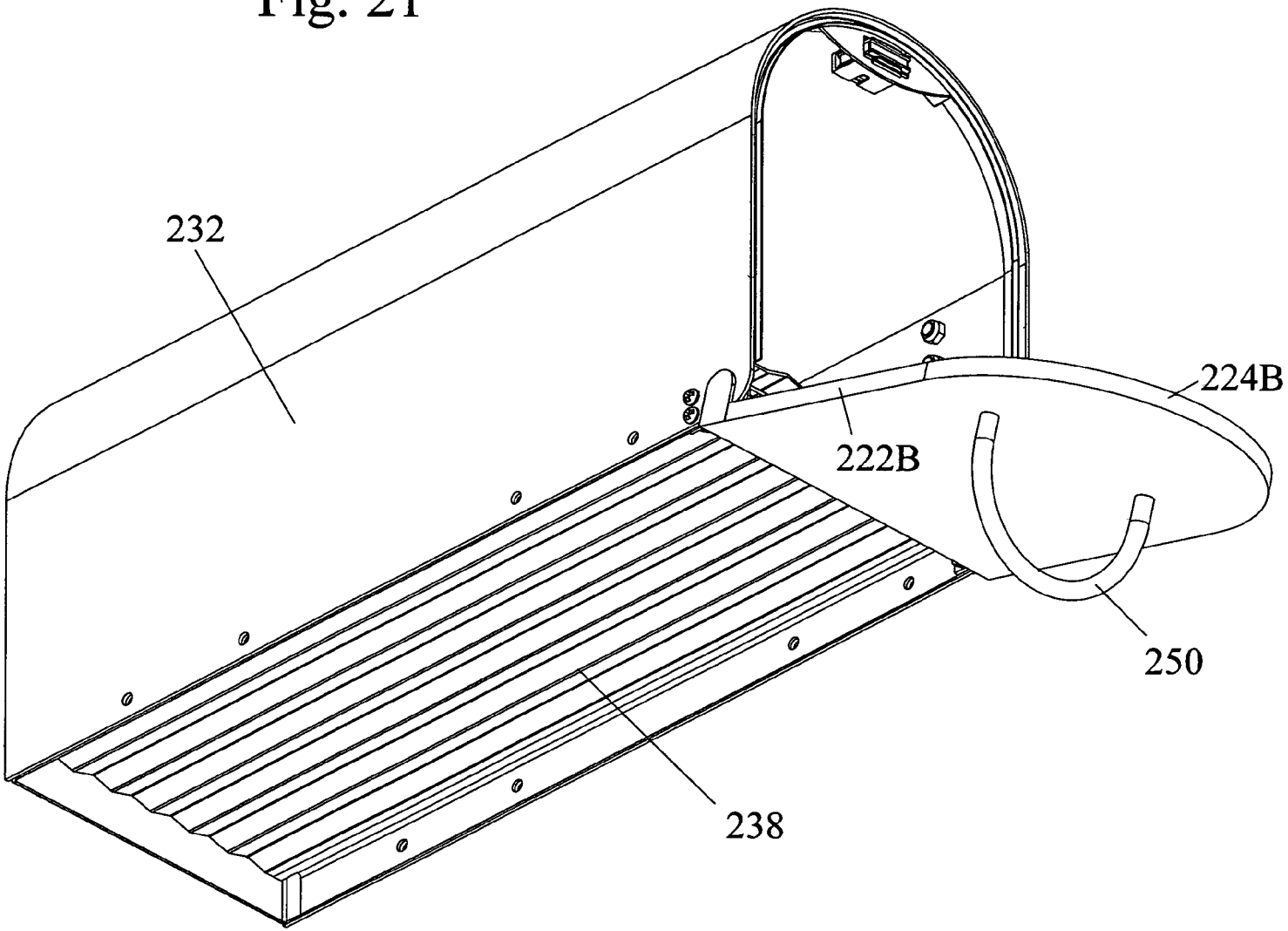
FIG. 21 is a perspective left lower front view of the mailbox of FIG. 20 with door open.
Figure 22:
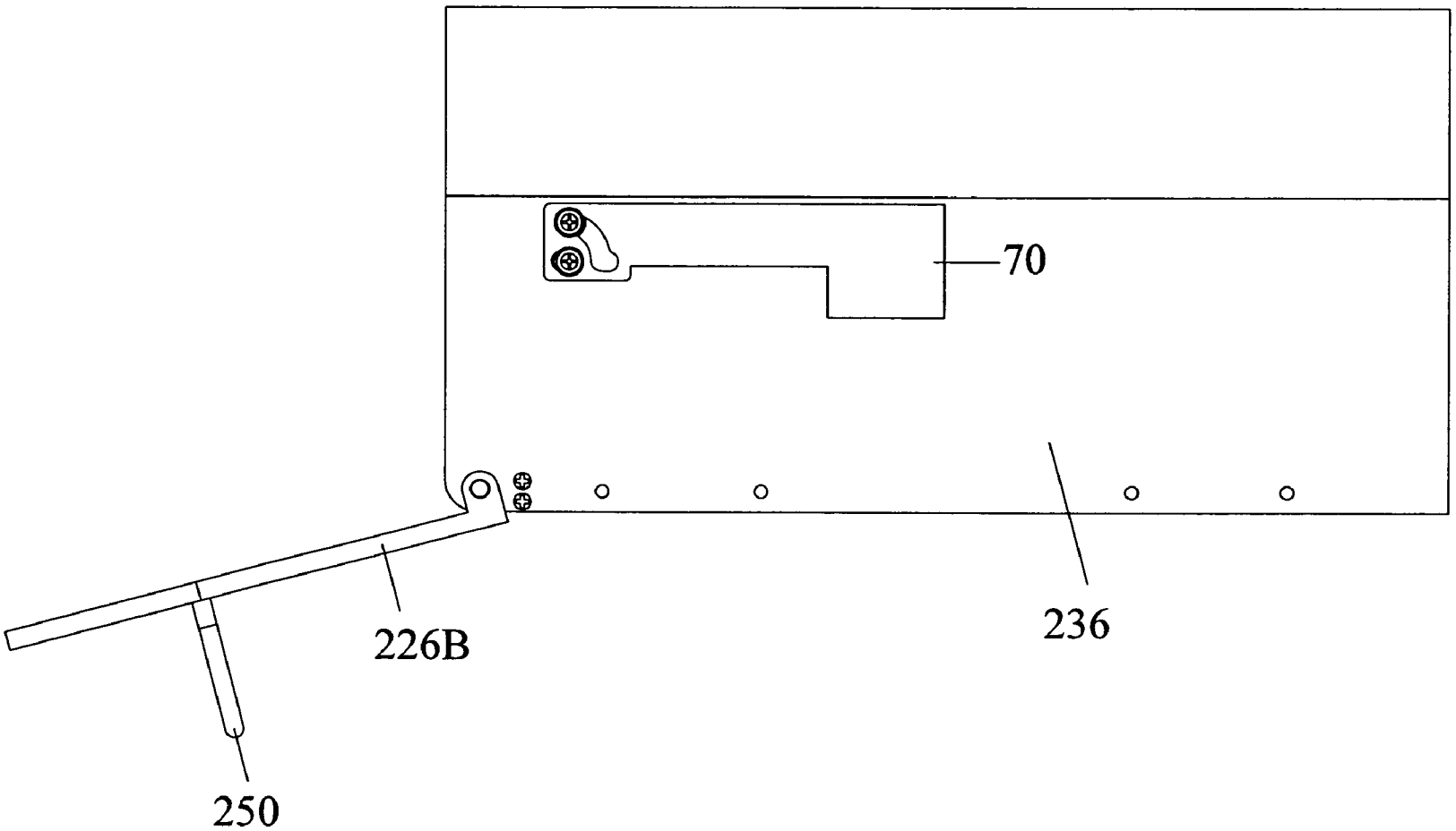
FIG. 22 is a right side view of the mailbox of FIG. 16 with door open.
Figure 23:
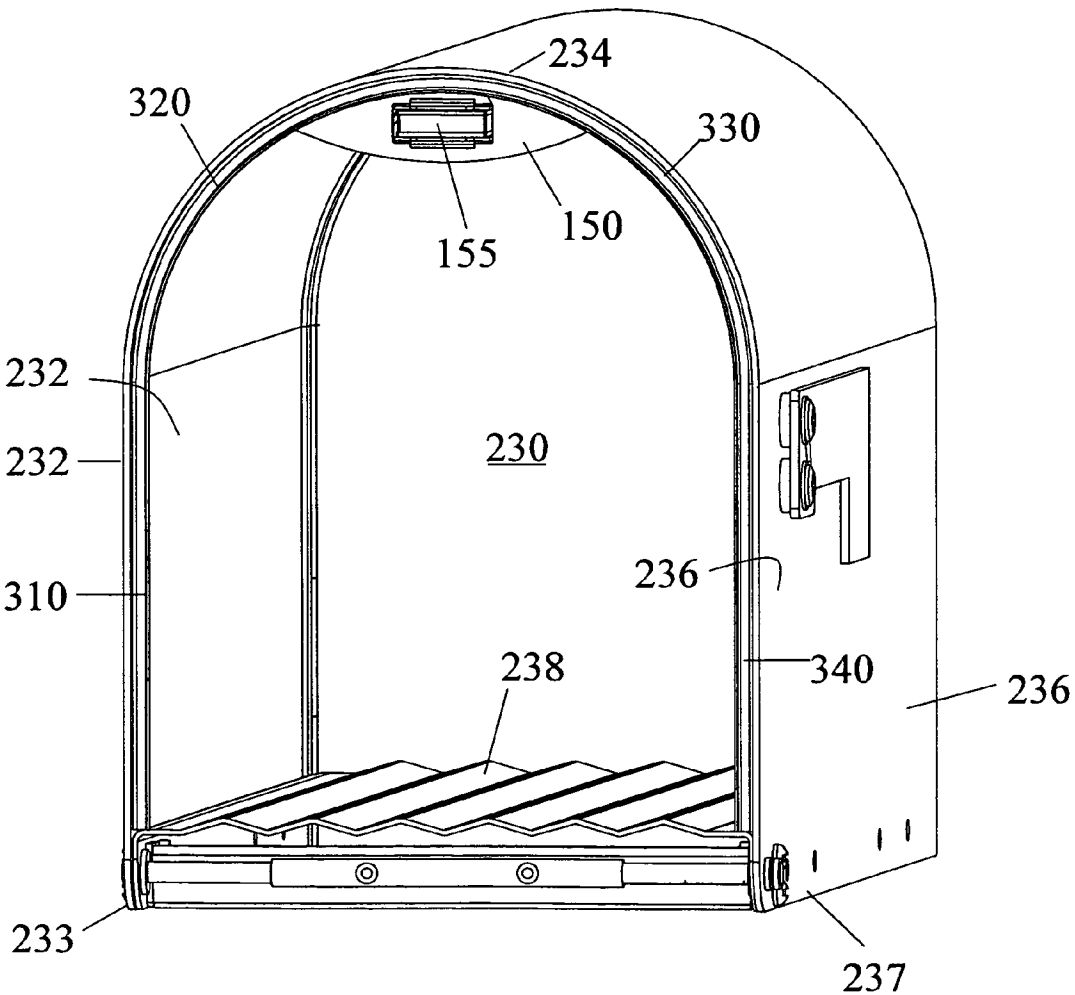
FIG. 23 is a perspective front end view of the mailbox without a door.
Figure 24:
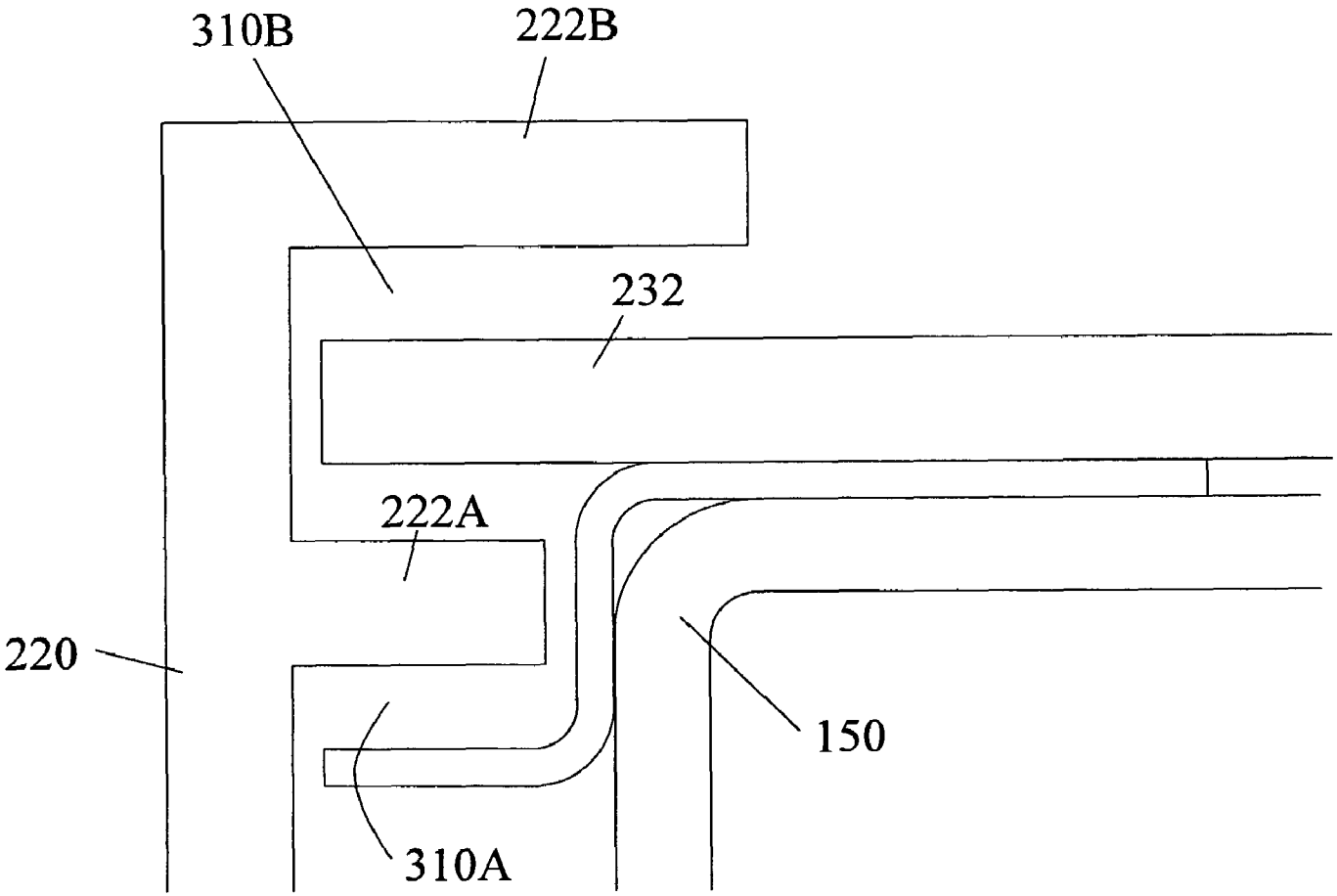
FIG. 24 is an enlarged cross-sectional view of the wrapping door in a closed position on the mailbox of the preceding figures.

FIG. 15 is a perspective right front view of a wrapping door 220 for the mailbox invention. FIG. 16 is a right side view of the mailbox 200 and closed door 220 of FIG. 15. FIG. 17 is a bottom view of the mailbox 200 and closed door 220 of FIG. 15. FIG. 18 is another perspective right front view of the mailbox 200 of FIG. 15 with door 220 open. FIG. 19 is a perspective right lower front view of the mailbox 200 of FIG. 18 with door 220 open. FIG. 20 is a perspective left front view of the mailbox 200 of FIG. 15 with door 220 open. FIG. 21 is a perspective left lower front view of the mailbox 200 of FIG. 20 with door 220 open. FIG. 22 is a right side view of the mailbox 200 of FIG. 16 with door 220 open. FIG. 23 is a perspective front end view of the mailbox 200 without a door 220. FIG. 24 is an enlarged cross-sectional view of the wrapping door 220 in a closed position on the mailbox 200 of the preceding figures.

Referring to FIGS. 15-24, the mailbox 200 with wrapping edge door 220 can include similar components to that of the preceding embodiment with additional features. The chamber 230 with left wall 232, left lower hanging sidewall 233, roof 234, right wall 236, and right lower hanging sidewall 237 and floor 238 correspond to similar components of the preceding embodiment. Similarly, the left side channel groove 310, upper left roof curved channel groove 320, upper right roof curved channel groove 330, and right side channel groove 340, correspond to similar numbered components in the preceding embodiment with the exception that the channel grooves are located at the open end of the mailbox 200.

In this other embodiment, the door 220 can be sized to fit about and wrap around the exposed end 210 of the mailbox 200. Door 220 can include a left side inwardly protruding door edge 222A, curved roof inwardly protruding door edge 224A, and right side inwardly protruding door edge 226A, each of which can fit into the respective channel grooves 310, 320 and 330 of the main chamber 330, and function similarly to that of the preceding embodiment figures.

In this embodiment, the door 220 can include a parallel set of outer left side inwardly protruding door edge 222B, an outer curved roof inwardly protruding door edge 224B, and an outer right side inwardly protruding door edge 226B. The outer edges 222B, 224B and 226B can wrap about the open end of the mailbox 200. As shown in FIG. 24, both an outer channel groove 310B and an inner channel groove 310A can be formed that also allows for sealing the inside of the chamber 230 of the mailbox 200 from moisture and water intrusion. The dual channel grooves can each allow for water to drain downward by gravity to exit underneath the mailbox 200.

Although the embodiments show the channel grooves being attached in place, the channel grooves can be molded or stampled or bent from existing ends of the main chamber.

While the channel grooves are part of the same material of the mailbox, the channel grooves can be a separate flange material that is attached in place, having the example, an L cross-sectional shape.

While the embodiments show a single door on the mailbox, the mailbox can include both a front and a rear door, with both ends of the mailbox having the novel channel groove drainage features.

Although the embodiments describe the invention being formed from metal, and the like, the invention can include a mailbox formed from molded plastic, and the like.

While the embodiments show the channel about the open end of the mailbox, the channel can be part of the inside edges of the door(s) to the mailbox.

Although the preferred embodiments show the mailbox being formed from metal, the mailbox can be formed from molded plastic and the like, with the channel grooves molded in place. Still furthermore, the channel grooves can be separately formed in plastic and adhered in place by other fastening techniques such as glue, and the like.

The invention can also be retrofitted into existing mailboxes and/or made to be part of newly manufactured mailboxes.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they will fall within the breadth and scope of the claims here appended.

We claim:

1. A mailbox for receiving mail, comprising:

a chamber having an inside compartment, at least one open end for receiving the mail therethrough, and a bottom defining a generally flat floor with a front bottom edge;

a left channel having a U-shaped groove along a left front wall of the open end of the chamber, the left channel running continuously from a left side of the bottom to a top of the open end;

a right channel having a U-shaped groove along a right front wall of the open end of the chamber, the right channel running continuously from a right side of the bottom to the top of the open end, so that an upper end of the U-shaped groove of the right channel runs contiguously into an upper end of the U-shaped groove of the left channel;

a door having a generally flat bottom edge that is pivotally attached to the front bottom edge to the open end of the chamber, the door rotates from a closed position to an open position, the door having a top, a left side, a right side, an inwardly facing left flange running continuously along the left side of the door between the flat bottom edge and the top, and an inwardly facing right flange running continuously along the right side of the door between the flat bottom edge and the top, so that an upper end of the inwardly facing left flange runs contiguously into an upper end of the inwardly facing right flange, wherein the door in the closed position has a portion of both the left side inwardly facing flange and a portion of the right side inwardly facing flange that protrudes into the left and the right channel grooves, and seals the inside compartment from water intrusion; and a through-hole opening in the floor of the mailbox adjacent to the open end for directing water entering into the mailbox to drain outside of the mailbox.

2. A mailbox for receiving mail, comprising:

a chamber having an inside compartment, at least one open end for receiving the mail therethrough, and a bottom defining a generally flat floor with a front bottom edge;

a left channel having a U-shaped groove along a left front wall of the open end of the chamber, the left channel running continuously from a left side of the bottom to a top of the open end;

a right channel having a U-shaped groove along a right front wall of the open end of the chamber, the right channel running continuously from a right side of the bottom to the top of the open end, so that an upper end of the U-shaped groove of the right channel runs contiguously into an upper end of the U-shaped groove of the left channel;

a door having a generally flat bottom edge that is pivotally attached to the front bottom edge to the open end of the chamber, the door rotates from a closed position to an open position, the door having a top, a left side, and a right side collectively defining a perimeter portion of the door, and an inwardly facing flange running about the entire perimeter portion of the door, wherein the door in the closed position has a portion of the inwardly facing flange that protrudes into the left and the right channel grooves, and seals the inside compartment from water intrusion; and at least one of a left opening in the floor of the mailbox adjacent to the left channel groove for directing water entering into the mailbox to drain outside of the mailbox, and a right opening in the floor of the mailbox adjacent to the right channel groove for directing water from entering into the mailbox to drain outside of the mailbox.

3. A mailbox for receiving mail, comprising:

a chamber having an inside compartment, at least one open end for receiving mail therethrough, and a bottom defining a generally flat floor with a front bottom edge;

a channel having a U-shaped groove that runs continuously about a left side and a top and a right side of the open end of the chamber; and a door having a generally flat bottom edge that is pivotally attached to the front bottom edge to the open end of the chamber, the door rotates from a closed position to an open position, the door having a top, a left side, a right side, wherein the door in the closed position has a portion that protrudes into the channel groove, and seals the inside compartment from water intrusion, wherein the door includes:

a pair of inwardly bent outer edges that runs continuously about the left side, the top and the right side of the door, wherein an inner inwardly bent outer edge defines the portion and fits into the channel groove when the door is in the closed position, and an outer inwardly bent outer edge wraps about and outside the open end of the chamber.

4. A mailbox for receiving mail, comprising:

a chamber having an inside compartment, at least one open end for receiving the mail therethrough, and a bottom defining a generally flat floor with a front bottom edge;

a left channel having a U-shaped groove along a left front wall of the open end, the left channel U-shaped groove having an upper inwardly curved portion;

a right channel having a U-shaped groove along a right front wall of the open end, the right channel U-shaped groove having an upper inwardly curved portion; and a door having a generally flat bottom edge that is pivotally attached to the front bottom edge to the open end of the chamber, the door rotates from a closed position to an open position, the door having a pair of elongated inwardly bent outer edges being parallel to one another, wherein one of the elongated inwardly bent outer edge wraps about and outside the open end of the chamber, and the other of the elongated inwardly bent outer edges protrudes into the left and the right channel grooves when the door is in the closed position, and seals the inside compartment from water intrusion.

5. A method of inhibiting moisture and water intrusion into mailboxes, comprising the steps of:

providing a mailbox with at least one open end for receiving mail therethrough, and a bottom defining a generally flat floor with a front bottom edge;

providing a door having a generally flat bottom edge that is pivotally attached to the front bottom edge to the open end of the mailbox, the door being able to pivot between an open position and a closed position;

forming direction channels having U-shaped grooves around a left side, a top, and a right side of the open end of the mailbox; and forming a pair of elongated inwardly bent outer edges on the door wherein one of the elongated inwardly bent outer edges wraps about and outside the open end of the mailbox, and the other of the elongated inwardly bent outer edges protrudes into the channel grooves when the door is in the closed position.

* * * * *